US010071401B2

(12) United States Patent
Dunkin et al.

(10) Patent No.: US 10,071,401 B2
(45) Date of Patent: Sep. 11, 2018

(54) FEED CONTROL DEVICE FOR PLUMBING TOOLS

(71) Applicant: Ridge Tool Company

(72) Inventors: Jon R. Dunkin, Elyria, OH (US); Michael J. Rutkowski, Brunswick, OH (US); Alex M. Cole, Parma, OH (US); Larry F. Babb, Grafton, OH (US)

(73) Assignee: Ridge Tool Company, Elyria, OH (US)

( * ) Notice: Subject to any disclaimer, the term of this patent is extended or adjusted under 35 U.S.C. 154(b) by 851 days.

(21) Appl. No.: 14/580,367

(22) Filed: Dec. 23, 2014

(65) Prior Publication Data

US 2016/0175899 A1 Jun. 23, 2016

(51) Int. Cl.

| | |
|---|---|
| ***B08B 9/04*** | (2006.01) |
| ***B08B 9/045*** | (2006.01) |
| ***E03F 9/00*** | (2006.01) |
| *B08B 9/043* | (2006.01) |

(52) U.S. Cl.

CPC ..... *B08B 9/045* (2013.01); *B08B 9/04* (2013.01); *E03F 9/005* (2013.01); *B08B 9/043* (2013.01)

(58) Field of Classification Search

CPC ..... B08B 9/04; B08B 9/043; B08B 9/045
USPC ..... 15/104.33, 104.31, 143
See application file for complete search history.

(56) References Cited

U.S. PATENT DOCUMENTS

| | | | | |
|---|---|---|---|---|
| 2,204,638 | A | 6/1940 | Weathers | |
| 3,224,024 | A | 12/1965 | Hunt | |
| 3,394,599 | A | 7/1968 | Tucker | |
| 3,451,089 | A | 6/1969 | Carlson et al. | |
| 3,777,578 | A | 12/1973 | Swanberg | |
| 4,246,802 | A | 1/1981 | Rasmussen et al. | |
| 5,029,356 | A | 7/1991 | Silverman et al. | |
| 5,031,263 | A | 7/1991 | Babb et al. | |
| 5,031,276 | A * | 7/1991 | Babb | B08B 9/045 15/104.31 |
| 5,239,724 | A * | 8/1993 | Salecker | E03F 9/005 15/104.33 |
| 5,640,736 | A | 6/1997 | Salecker | |
| 5,901,401 | A * | 5/1999 | Rutkowski | E03F 9/005 15/104.31 |
| 6,009,588 | A * | 1/2000 | Rutkowski | B08B 9/045 15/104.33 |
| 6,158,076 | A * | 12/2000 | Rutkowski | E03F 9/005 15/104.31 |
| 6,243,905 | B1 | 6/2001 | Rutkowski | |

(Continued)

OTHER PUBLICATIONS

International Search Report (ISR) and Written Opinion; PCT/US15/66567; dated Feb. 23, 2016 (13 Pages).

*Primary Examiner* — Michael Jennings
(74) *Attorney, Agent, or Firm* — Mark E. Bandy; Rankin, Hill & Clark LLP

(57) ABSTRACT

Various feed control devices for plumbing tools such as drain cleaning machines are disclosed. The feed control devices include a collection of angled rollers that contact a cable or snake of the drain cleaning machine. Another collection of a single or dual angled roller(s) are mounted or otherwise engaged with a handle, and can be selectively positioned and contacted with the cable. By changing the position of the handle, rotation of the cable is translated to axial movement thereby advancing or retracting the cable. Also described are drain cleaning devices utilizing the feed control devices.

13 Claims, 39 Drawing Sheets

(56) References Cited

U.S. PATENT DOCUMENTS

| | | | | |
|---|---|---|---|---|
| 6,343,398 | B1 * | 2/2002 | Silverman | B08B 9/045 15/104.31 |
| 6,360,397 | B1 * | 3/2002 | Babb | B08B 9/045 15/104.33 |
| 6,655,228 | B1 | 12/2003 | Margherio et al. | |
| 7,685,669 | B2 | 3/2010 | Rutkowski et al. | |
| 2005/0193508 | A1 | 9/2005 | Rutkowski et al. | |
| 2008/0244816 | A1 | 10/2008 | Babb et al. | |
| 2016/0175899 | A1 * | 6/2016 | Dunkin | B08B 9/045 15/104.33 |

* cited by examiner

FEED CONTROL DEVICE FOR PLUMBING TOOLS

FIELD

The present subject matter relates to feed control assemblies used in drain cleaning tools such as drum type drain cleaners. More particularly, the present subject matter relates to an improved feed control arrangement in which a flexible snake used in typical drum type drain cleaners can be axially advanced and retracted during a drain cleaning operation. The present subject matter also relates to drain cleaners utilizing the feed control assemblies described herein.

BACKGROUND

It is known to provide manually operable feed control devices for advancing and retracting a drain cleaning cable or "snake" relative to a drain being cleaned. In some such devices, a plurality of rollers are supported in a housing, or the like, through which the snake extends, and the rollers are spaced apart around the periphery of the snake. The rollers have neutral and engaged positions relative to the snake. The positions of the rollers are such that when the snake rotates, the snake is axially displaced relative to the rollers and the device. In some designs, the rollers are skewed relative to the axis of the snake so as to axially displace the snake in one direction relative to the housing in response to rotation of the snake in one direction. Axial displacement of the snake in the opposite direction is achieved by reversing the direction of rotation of the snake. Examples of an arrangement of this type are shown in U.S. Pat. No. 5,901,401 to Rutkowski, et al., U.S. Pat. No. 6,009,588 to Rutkowski, and U.S. Pat. No. 6,158,076 to Rutkowski, et al. In other designs, axial displacement of the snake in opposite directions relative to the housing is achieved by rotating the snake in just one direction and reversing the skew of the rollers relative thereto. Such an arrangement is shown, for example, in U.S. Pat. No. 5,031,276 to Babb, et al.

More recent feeding devices of the latter type are disclosed in U.S. Pat. No. 6,360,397 to Babb in which the skew of the rollers is reversible by relative rotational displacement of housing members in which the rollers are supported, and in U.S. Pat. No. 6,655,228 to Margherio, et al. wherein two pairs of rollers are axially spaced apart in a housing and a third roller is mounted axially therebetween and is shiftable to selectively engage the snake against one or the other of the roller sets.

The power source by which a drain cleaning snake is rotated can be a handheld, crank operated drain cleaner such as shown for example in the noted U.S. Pat. No. 6,158,076 to Rutkowski, et al.; a trigger actuated motor driven drain cleaner such as shown, for example, in U.S. Pat. No. 3,224,024 to Hunt and U.S. Pat. No. 5,029,356 to Silverman, et al.; or somewhat larger, ground-supported drain cleaners such as are shown for example in U.S. Pat. No. 4,580,306 to Irwin, U.S. Pat. No. 5,031,263 to Babb, et al., and U.S. Pat. No. 5,239,724 to Salecker, et al.

The control devices which do not require reversal of the direction of rotation of the snake in order to achieve displacement thereof in axially opposite directions are advantageous for a number of reasons. In this respect, for example, operation of the drain cleaning apparatus is made easier for the user by not having to manipulate a reversing switch for the drive motor. At the same time, however, currently known arrangements for axially displacing a snake in opposite directions without changing the direction of rotation of the snake are structurally complex and at least somewhat cumbersome to operate in requiring the user to manipulate at least one and sometimes two components to achieve reversal of the direction of the snake drive.

In addition, feed control devices used on many drain cleaners typically utilize a lever that is moved in directions to engage the snake, which some users may consider as being not intuitive. That is, in order to extend or advance the snake, the lever is moved in one direction which is different than the direction of cable extension; and in order to retract the snake, the lever is moved in another direction which is different than the direction of cable retraction. And, in many instances the lever must be manually returned to a neutral position after desired cable extension or retraction.

Accordingly, it would be desirable to provide a feed control assembly for a drain cleaning device that used an intuitive lever mechanism such that in order to extend the snake, the lever is moved in the same direction as snake extension; and in order to retract the snake, the lever is moved in the same direction as snake retraction. In addition, it would be desirable to provide such a feed control assembly in which the lever is biased toward a neutral position.

SUMMARY

The difficulties and drawbacks associated with previous approaches are addressed in the present subject matter as follows.

In one aspect, the present subject matter provides a feed control device comprising a lower member including a plurality of rollers rotatably supported thereon. The feed control device also comprises an upper member including at least one roller rotatably supported thereon. The feed control device additionally comprises a handle engaged with the upper member. The upper member is pivotally engaged with the lower member. The upper member and the handle are positionable between a forward position and a rearward position. Upon placement of a drain cleaning cable between the plurality of rollers of the lower member and the at least one roller of the upper member, and rotation of the drain cleaning cable about its axis, movement of the upper member and the handle to the forward position results in cable displacement in the same forward direction, and movement of the upper member and the handle to the rearward position results in cable displacement in the same rearward direction.

In another aspect, the present subject matter provides a feed control device comprising a lower member including a plurality of rollers rotatably supported thereon. The lower member defines a front region and an opposite rear region. The feed control device also comprises an upper member pivotally engaged with the lower member. The feed control device additionally comprises a handle rotationally engaged with the upper member. The handle includes an upper roller rotatably supported thereon. Upon placement of a drain cleaning cable between the plurality of rollers of the lower member and the upper roller and rotation of the drain cleaning cable about its axis, positioning of the upper member and the handle so that the upper roller is closer to the front region of the lower member than the rear region and contacting the upper roller with the drain cleaning cable, results in cable displacement in a forward direction.

In yet another aspect, the present subject matter provides a feed control device comprising a lower member including a plurality of rollers rotatably supported thereon. The lower member defines a front region and an opposite rear region. The lower member also includes a rotatable post extending at least partially above the plurality of rollers. The feed control device also comprises a handle pivotably engaged with the post. The handle includes an upper roller rotatably supported thereon. Upon placement of a drain cleaning cable between the plurality of rollers of the lower member and the upper roller and rotation of the drain cleaning cable about its axis, positioning of the handle so that the upper roller is closer to the front region of the lower member than the rear region and contacting the upper roller with the drain cleaning cable, results in cable displacement in a forward direction.

In still another aspect, the present subject matter provides a drain cleaner comprising a frame, a rotatable drum supported on the frame, a motor operably engaged with the drum for rotating the drum, and a length of a drain cleaning cable at least partially retained in the drum. The drain cleaner also comprises a feed control device for controlling extension and retraction of the drain cleaning cable from the drum. The feed control device includes a lower member including a plurality of rollers rotatably supported thereon, an upper member including at least one roller rotatably supported thereon, and a handle engaged with the upper member. The upper member is pivotally engaged with the lower member and the upper member and the handle are positionable between a forward position and a rearward position. Upon placement of the drain cleaning cable between the plurality of rollers of the lower member and the at least one roller of the upper member, and rotation of the drain cleaning cable about its axis, movement of the upper member and the handle to the forward position results in cable displacement in the same forward direction, and movement of the upper member and the handle to the rearward position results in cable displacement in the same rearward direction.

In yet another aspect, the present subject matter provides a drain cleaner comprising a frame, a rotatable drum supported on the frame, a motor operably engaged with the drum for rotating the drum, and a length of a drain cleaning cable at least partially retained in the drum. The drain cleaner also comprises a feed control device for controlling extension and retraction of the drain cleaning cable from the drum. The feed control device includes a lower member including a plurality of rollers rotatably supported thereon. The lower member defines a front region and an opposite rear region. The feed control device also includes an upper member pivotally engaged with the lower member, and a handle rotationally engaged with the upper member. The handle includes an upper roller rotatably supported thereon. Upon placement of the drain cleaning cable between the plurality of rollers of the lower member and the upper roller and rotation of the drain cleaning cable about its axis, positioning of the upper member and the handle so that the upper roller is closer to the front region of the lower member than the rear region and contacting the upper roller with the drain cleaning cable, results in cable displacement in a forward direction.

In still a further aspect, the present subject matter provides a drain cleaner comprising a frame, a rotatable drum supported on the frame, a motor operably engaged with the drum for rotating the drum, and a length of a drain cleaning cable at least partially retained in the drum. The drain cleaner also includes a feed control device for controlling extension and retraction of the drain cleaning cable from the drum. The feed control device includes a lower member including a plurality of rollers rotatably supported thereon. The lower member defines a front region and an opposite rear region. The lower member also includes a rotatable post extending at least partially above the plurality of rollers. The feed control device additionally includes a handle pivotably engaged with the post. The handle includes an upper roller rotatably supported thereon. Upon placement of the drain cleaning cable between the plurality of rollers of the lower member and the upper roller and rotation of the drain cleaning cable about its axis, positioning of the handle so that the upper roller is closer to the front region of the lower member than the rear region and contacting the upper roller with the drain cleaning cable, results in cable displacement in a forward direction.

As will be realized, the subject matter described herein is capable of other and different embodiments and its several details are capable of modifications in various respects, all without departing from the claimed subject matter. Accordingly, the drawings and description are to be regarded as illustrative and not restrictive.

DETAILED DESCRIPTION OF THE EMBODIMENTS

Figure 1:
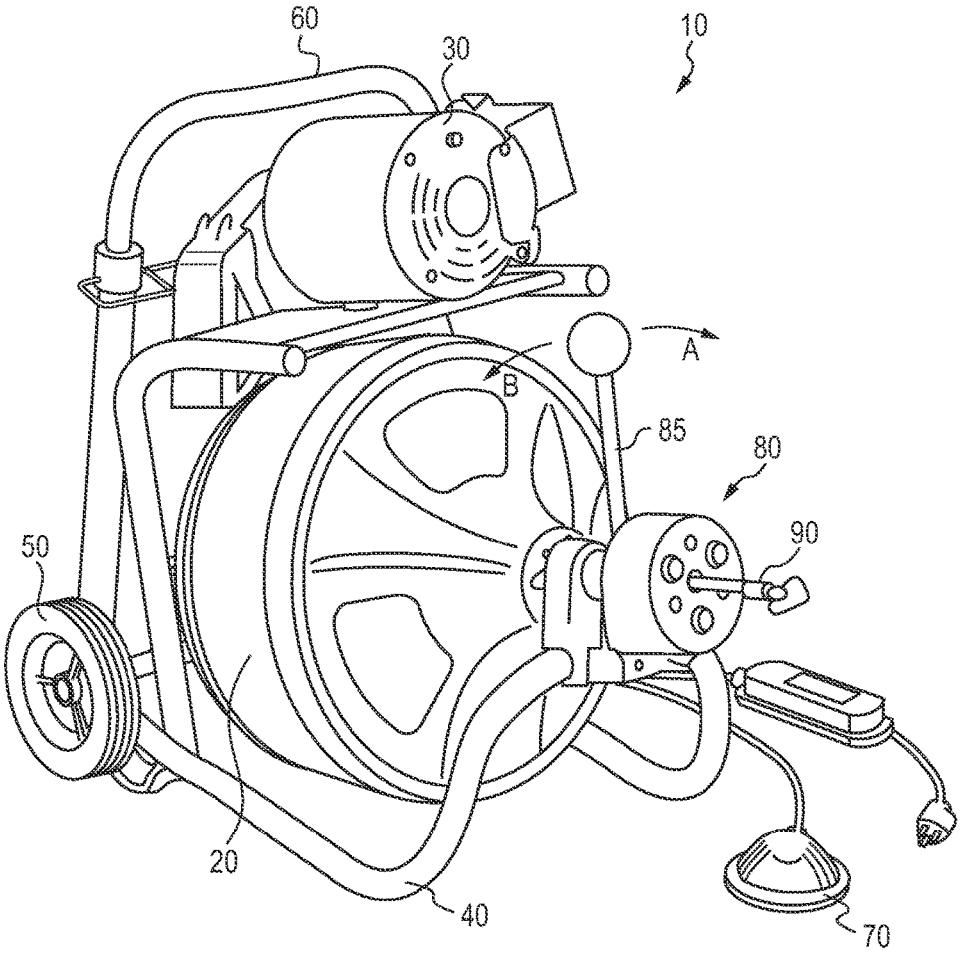
FIG. 1 (PRIOR ART)
FIG. 1 is a perspective view of a typical drum type drain cleaner with a feed control unit.

Generally, various drain cable feed control mechanisms and drain cleaners using such are provided which comprise a handle and a collection of skewed rollers, which as a result of their angled orientation to a cable or "snake" placed between the rollers, translate rotational movement of the cable to linear or axial movement. Specifically, in one set of embodiments the feed control mechanism includes a total of five (5) rollers, in which two pairs of rollers form a lower group and a fifth roller is rotatably mounted on a pivotal handle and which roller serves as an upper roller. And in another set of embodiments, the mechanism includes a total of six (6) rollers, in which two pairs of rollers form a lower group and a third pair of rollers are rotatably mounted on a pivotal handle, and which third pair serve as upper rollers.

In all embodiments, the lower group of rollers is arranged in two sets of opposing pairs, i.e., a front region pair (also referred to as an upstream pair) and a rear region pair (also referred to as a downstream pair). The axis of rotation of each roller extends at an angle with respect to the longitudinal axis of the cable (and hence also with respect to the axis of rotation of the cable) in each of the X, Y, and Z planes. Details of roller constructions and angles of roller skew relative to the cable are described in the previously noted U.S. Pat. No. 5,901,401 for example. Typically, each roller is oriented at an angle within a range of about 20° to 40°, with 30° being used for many applications.

The upper and fifth roller, or fifth and sixth rollers, is(are) positionable with the noted handle and can be selectively placed in contact with a cable supported on the lower group of four rollers. The upper roller(s) is(are) also oriented such that the axis of rotation of each roller is at an angle with respect to the longitudinal axis of the cable. The upper roller(s) is(are) also oriented or skewed at the same angles previously noted for the lower group of rollers. The handle and the upper roller(s) positionable therewith can be rotated about a longitudinal axis of the handle in one set of embodiments and/or otherwise pivoted with the handle in another set of embodiments. Upon contacting the upper roller(s) with the cable, the roller(s) can be placed in one of two angled orientations with respect to the cable.

In operation, upon rotation of a cable positioned on the lower group of four rollers, the upper roller(s) is(are) urged into contact with the cable by lowering or otherwise positioning the handle. In a first position of the upper roller(s), clockwise rotation of the cable is translated to linear axial cable displacement. In a second position of the upper roller(s), clockwise rotation of the cable is translated to linear axial cable displacement in an opposite direction. Counterclockwise rotation of the cable results in opposite linear displacement of the cable. As previously noted, selection between the first and second positions of the upper roller(s) is achieved by selective rotation of the handle about its longitudinal axis and/or by selective pivoting of the handle about a pivot axis. In certain embodiments, the lever is configured such that movement of the handle in a direction of cable extension, results in cable extension; and movement of the handle in an opposite direction, i.e., a direction of cable retraction, results in cable retraction. And, in all embodiments, optional biasing provisions can be included in the mechanisms so that the handle is biased to a neutral position in which cable is neither extended nor retracted.

An operator may also selectively vary the amount of force and thus friction applied between the rollers and the rotating cable by exerting a force on the handle. This provides greater control for an operator over operation, i.e., advancement or retraction of the cable. All of these aspects are described in greater detail herein.

FIG. 1 illustrates a conventional drum type drain cleaner 10 having a rotatable drum 20, an electric motor 30 in operable engagement for rotating the drum 20, a frame 40 for supporting the various components, optional wheels 50, an optional extendable handle 60, and a foot operated controller 70 for controlling operation of the motor 30. A length of a drain cleaning cable 90 is stored in the drum 20. The drain cleaner 10 also includes a feed control device 80 which governs extension and retraction of the cable. The feed control device 80 includes a handle 85 which is moved to various positions to select cable extension, cable retraction, or neither extension or retraction. For example, referring to FIG. 1, moving the handle 85 from its neutral position, in which the cable 90 is neither extended or retracted, in the direction of arrow A, results in one of cable extension or retraction. And, moving the handle 85 from its neutral position in the direction of arrow B, results in the other of cable extension or retraction. Although the feed control device 80 shown in FIG. 1 includes a handle 85, it will be understood that a wide array of selectors and actuators are known in the art for use with feed control devices.

For a user standing along a left side of the drain cleaner 10, pushing the handle 85 in the direction of arrow A may result in cable extension. If the user at a later point in time stands along a right side of the drain cleaner 10 and wishes to extend the cable, the user may push the handle 85 as the user recalls that cable extension occurs by pushing of the handle 85. However, as will be appreciated, since the user is standing on the right side of the drain cleaner 10, extension of the cable is achieved by pulling the handle and not by pushing the handle. Thus, in using the feed control device 80, control of cable extension and retraction may not be intuitive to all users.

Figure 2:
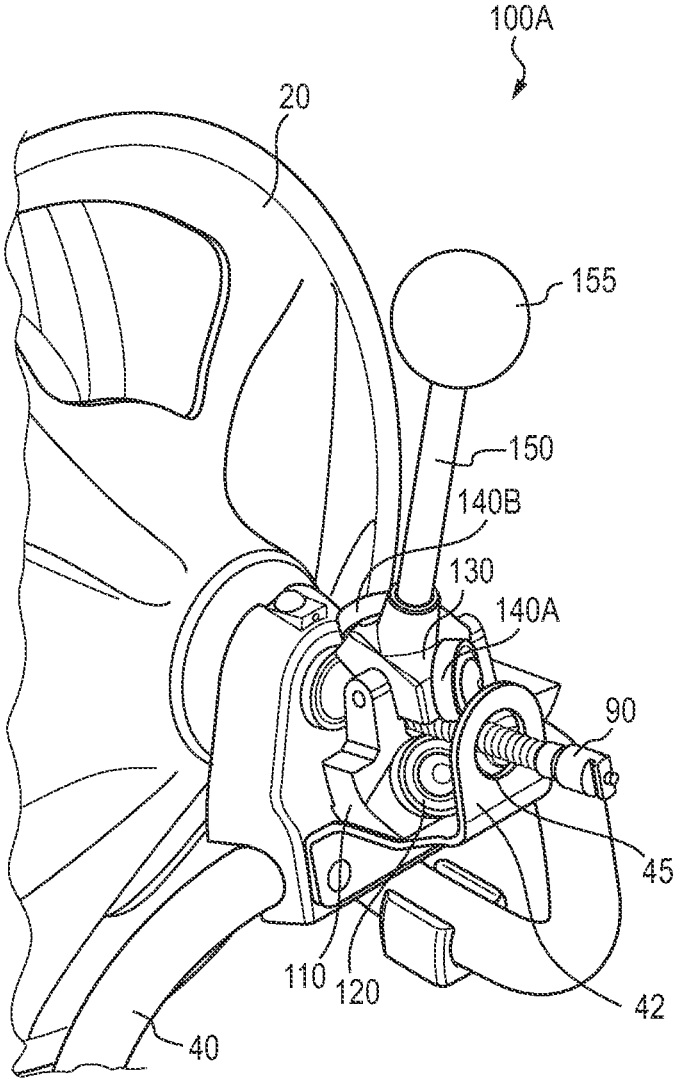
FIG. 2 is a perspective view of an embodiment of a feed control device in accordance with the present subject matter.
Figure 3:
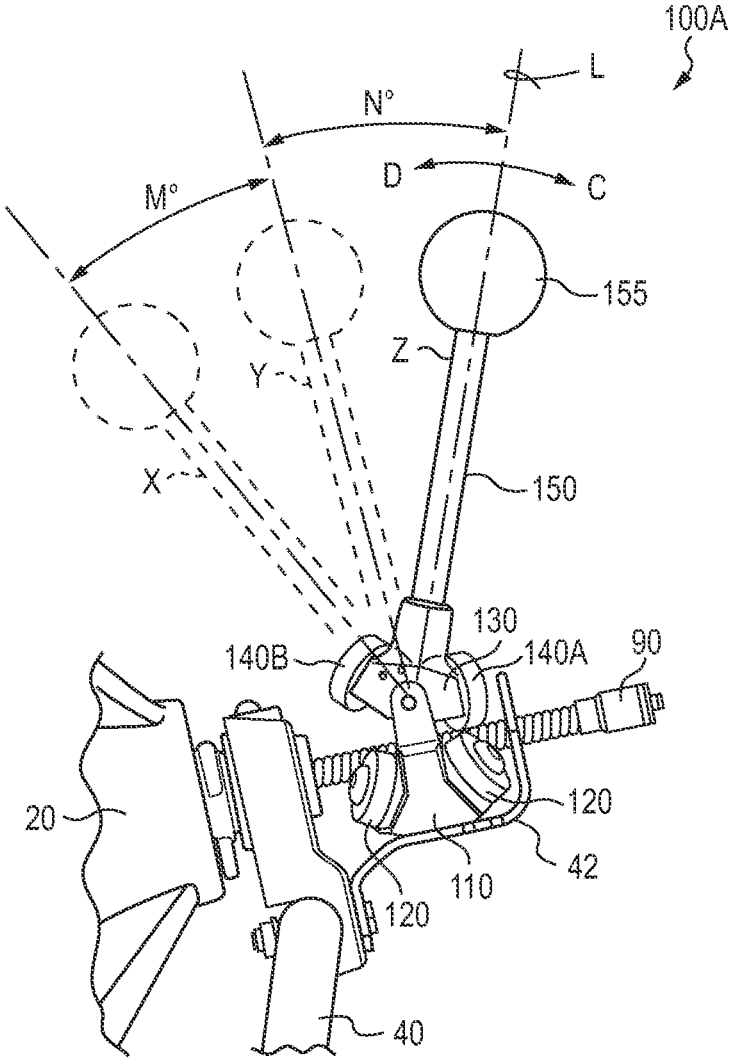
FIG. 3 is a side view of the feed control device depicted in FIG. 2.

FIGS. 2-3 illustrate a feed control device 100A in accordance with the present subject matter. The feed control device 100A comprises a lower member 110 with provisions for rotatably supporting a plurality of lower rollers 120, and an upper member 130 with provisions for rotatably supporting two upper rollers 140A and 140B. The upper member 130 is pivotally engaged with the lower member 110. The feed control device 100A also comprises a handle 150 engaged with the upper member 130. The handle 150 may optionally include a knob 155 or other component to promote gripping of the handle.

In operation, upon moving the handle 150 in the direction of arrow C (see FIG. 3), such as for example from an intermediate position Y to a forward position Z, contact occurs between the upper roller 140A and the cable 90 (undergoing rotation), which results in cable extension. Upon moving the handle 150 in the direction of arrow D, such as for example from the intermediate position Y to a rearward position X, contact occurs between the upper roller 140B and the cable 90, which results in cable retraction. This configuration provides a control feed device which has an operation that is more intuitive than previously known similar devices.

The feed control device 100A may optionally comprise biasing provisions which urge the lever 150 toward a neutral position, which can be for example the intermediate position Y depicted in FIG. 3. Biasing provisions are described in greater detail herein.

The various feed control devices of the present subject matter, such as for example the feed control device 100A, are typically supported on the frame 40 of the associated drain cleaning device. Although a wide array of supports can be used, a bracket 42 as shown in FIGS. 2 and 3 can be used which defines an aperture 45 through which the cable 90 extends.

Figure 4:
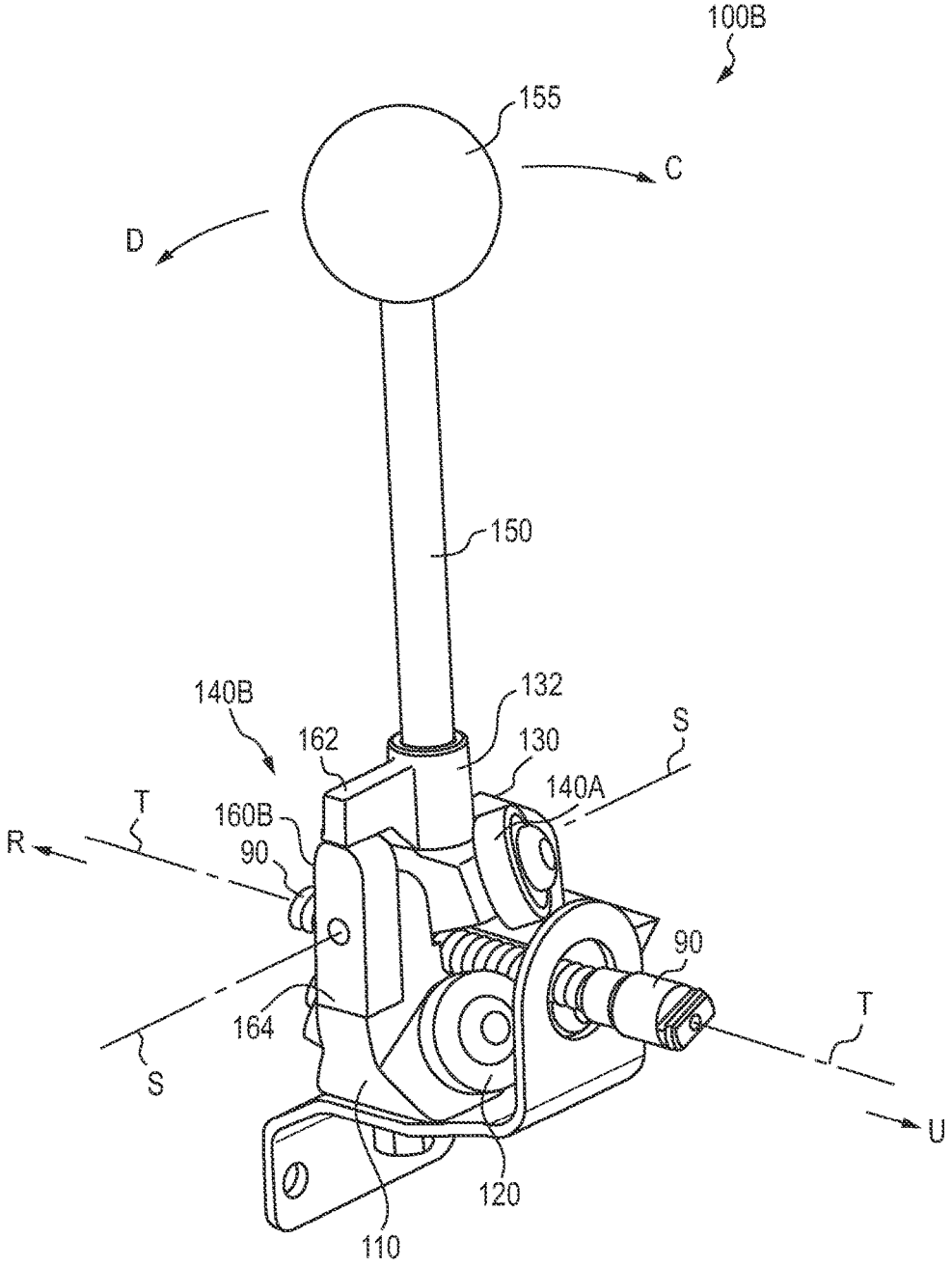
FIG. 4 is a perspective view of another version of the embodiment of the feed control device shown in FIGS. 2-3.

FIG. 4 illustrates another version 100B of the feed control device 100A depicted in FIGS. 2-3. The feed control device 100B shown in FIG. 4 includes optional biasing provisions that urge or bias the handle 150 to a neutral position. Specifically, the feed control device 100B includes an upper arm 162 that extends outward from the upper member 130 such as from a handle base 132 at which the handle 150 engages the upper member 130. The feed control device 100B also comprises biasing provisions such as a biasing member 160B for example. The biasing member 160B biases movement and/or position of the upper member 130 and/or the handle base 132, to the lower member 110. It will be understood that the biasing provisions generally extend between the upper and lower members 130, 110. The biasing member 160B can be in a variety of different forms. It will be appreciated that the member 160B can be in the form of a torsion spring, or could be in a form such as a coil spring. In operation, upon moving the handle 150 in the direction of arrow C, i.e., generally in the same direction as extension of cable 90 along its rotational axis T, the upper member 130 pivots about pivot axis S until contact occurs between the roller 140A and the cable 90. Thus, rotation of cable 90 results in axial linear movement of the cable 90 along axis T and in the direction of arrow U which corresponds to cable extension. Upon moving the lever 150 in the direction of arrow D, i.e., generally in the same direction as retraction of cable 90 along its rotational axis T, the upper member 130 pivots about pivot axis S until contact occurs between the roller 140B (not shown) and the cable 90. Thus, rotation of cable 90 results in axial linear movement of the cable along axis T and in the direction of arrow R which corresponds to cable retraction. In many embodiments, the pivotal engagement between the upper member 130 and the lower member 110 is such that the pivot axis S about which the upper member pivots, is perpendicular or substantially so, to the axis T of the cable 90. This orientation is taken upon placement of the cable between the rollers of the upper and lower members, and with regard to the axis of the cable within the feed control device.

FIGS. 5-10 illustrate another version 100C of the feed control devices 100A and 100B of FIGS. 2-4. The feed control device 100C also includes biasing provisions in the form of the biasing member 160, however, utilizes a different structure for affixing an end of the biasing member 160 to the upper member 130. The feed control device 100C includes a laterally extending projection 166 which projects laterally outward from the upper member 130. The biasing member 160 is affixed or otherwise secured to the projection 166.

Figure 5:
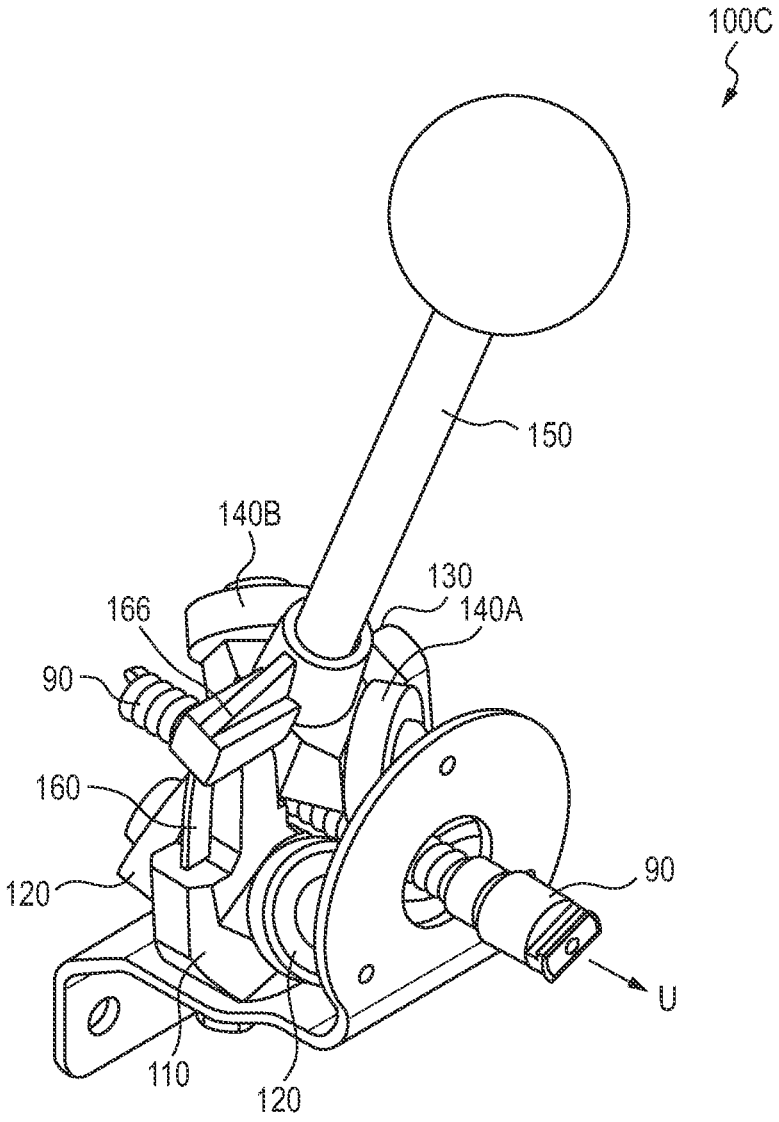
FIG. 5 is a perspective view of still another version of the embodiment of the feed control device of FIGS. 2-4, the device being in a cable advance position.
Figure 6:
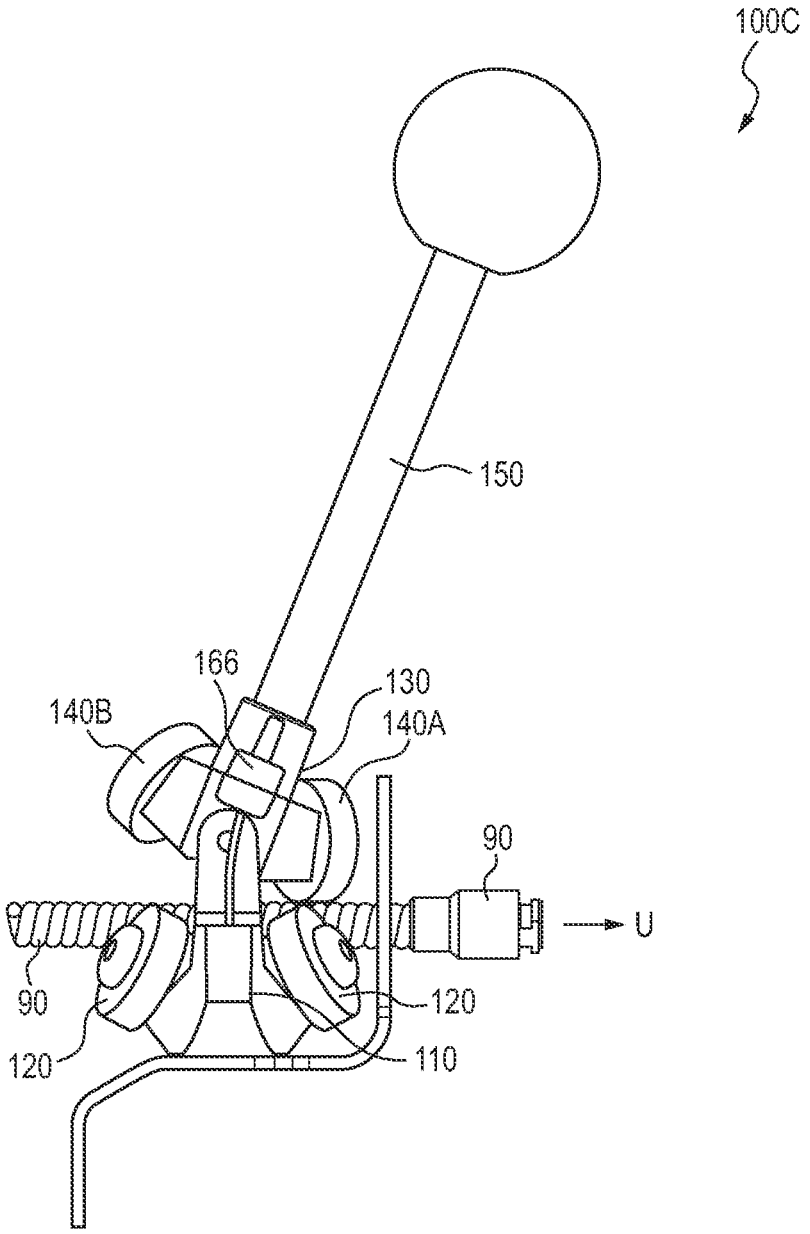
FIG. 6 is a side view of the feed control device shown in FIG. 5.

FIGS. 5-10 further illustrate various positions of the feed control device 100C. Specifically, FIGS. 5-6 illustrate the feed control device 100C having its upper member 130 and handle 150 in a cable advance position, similar to position Z depicted in FIG. 3, in which the cable 90 is linearly displaced in the direction of arrow U. In this position, contact occurs between the roller 140A and the cable 90. Contact does not occur between the roller 140B and the cable 90.

Figure 7:
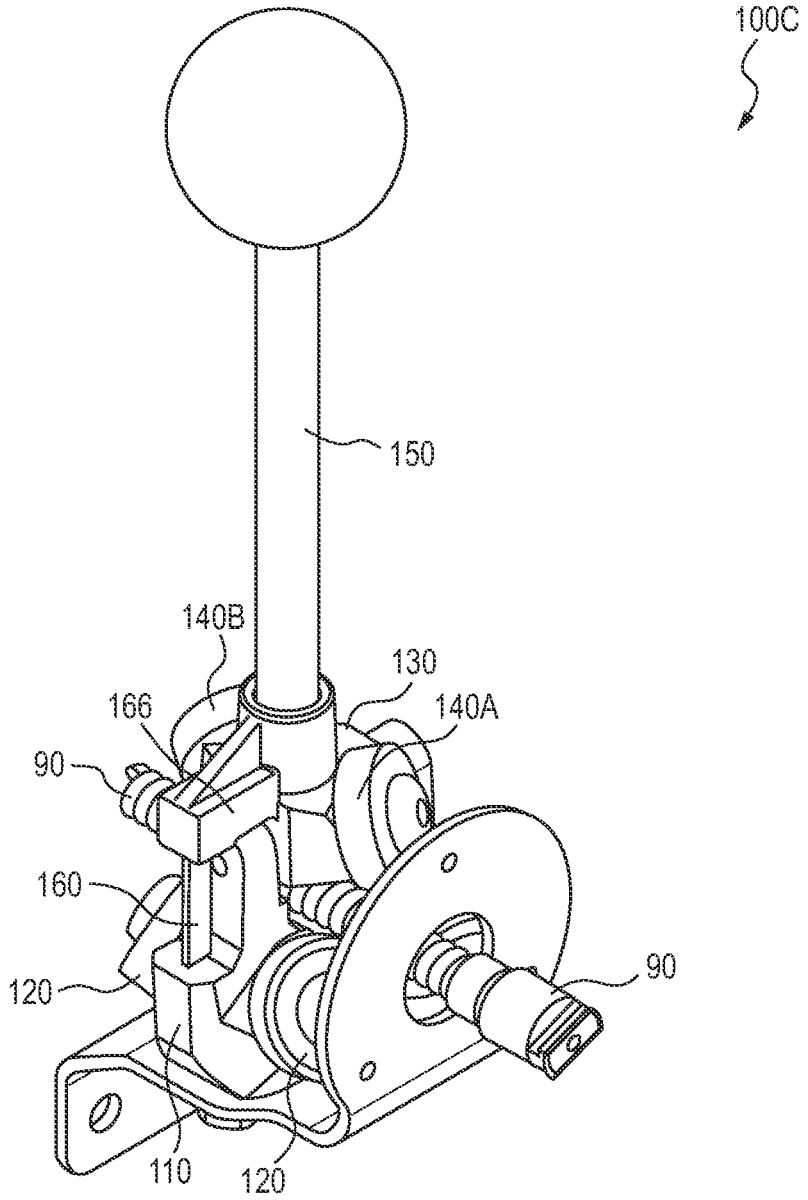
FIG. 7 is a perspective view of the feed control device of FIGS. 5 and 6, in a neutral position.
Figure 8:
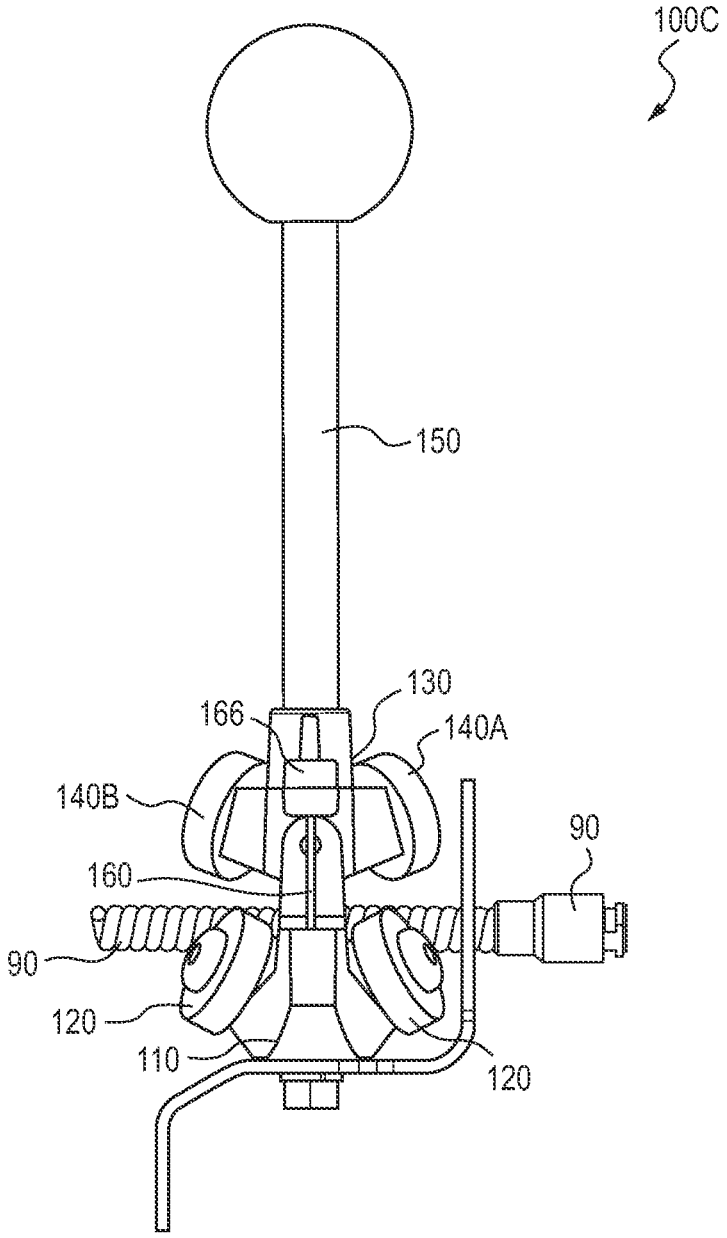
FIG. 8 is a side view of the feed control device depicted in FIG. 7.

FIGS. 7-8 illustrate the feed control device 100C having its upper member 130 and handle 150 in a neutral position similar to position Y of FIG. 3, in which neither cable extension nor cable retraction occurs. The biasing member 160 urges or biases the upper member 130 and handle 150 to this position. In this position, no contact occurs between the cable 90 and the rollers 140A and 140B as evident in FIG. 8.

Figure 9:
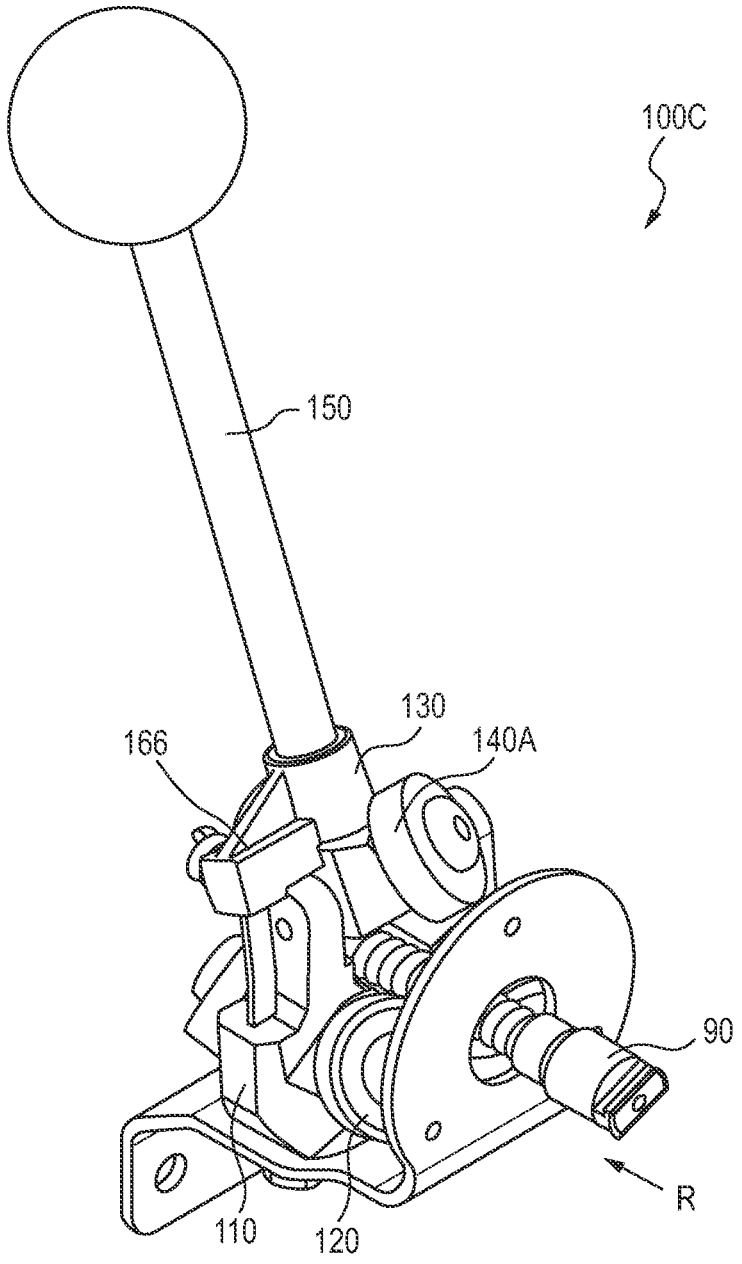
FIG. 9 is a perspective view of the feed control device of FIGS. 5-8, in a cable retract position.
Figure 10:
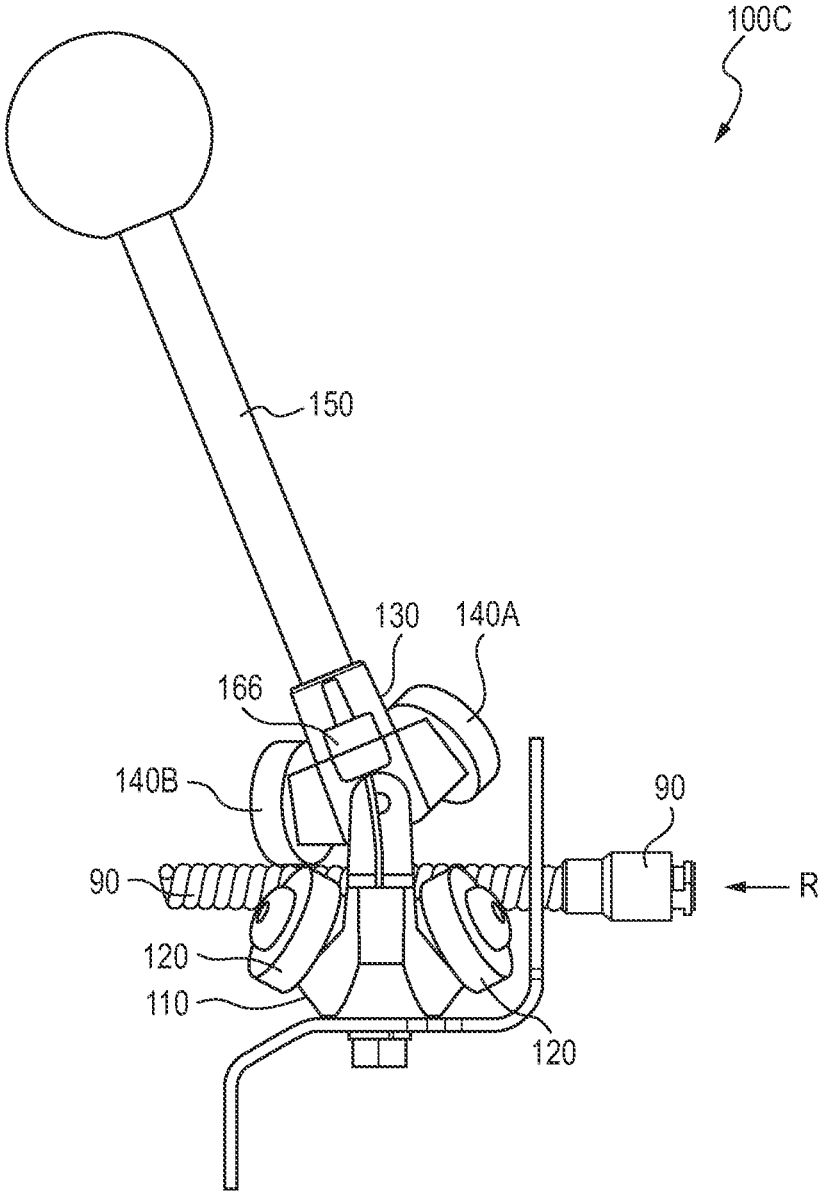
FIG. 10 is a side view of the feed control device shown in FIG. 9.

FIGS. 9-10 illustrate the feed control device 100C having its upper member 130 and handle 150 in a cable retract position, similar to position X shown in FIG. 3, in which the cable 90 is linearly displaced in the direction of arrow R. In this position, contact occurs between the roller 140B and the cable 90. Contact does not occur between the roller 140A and the cable 90.

In certain versions of the feed control devices 100A, 100B, and 100C and others, particular angular orientations are used between the intermediate, rearward, and forward positions of the handle. For example, referring to FIG. 3, the angular difference N° between the intermediate position Y and the forward position Z as measured from a longitudinal axis L of the handle 150 is within a range of from 10° to 45°. In particular versions, the angular difference N° is 22°. The angular difference M° between the intermediate position Y and the rearward position X as measured from the longitudinal axis L of the handle 150 is within a range of from 10° to 45°. In particular versions, the angular difference M° is 22°.

Figure 11:
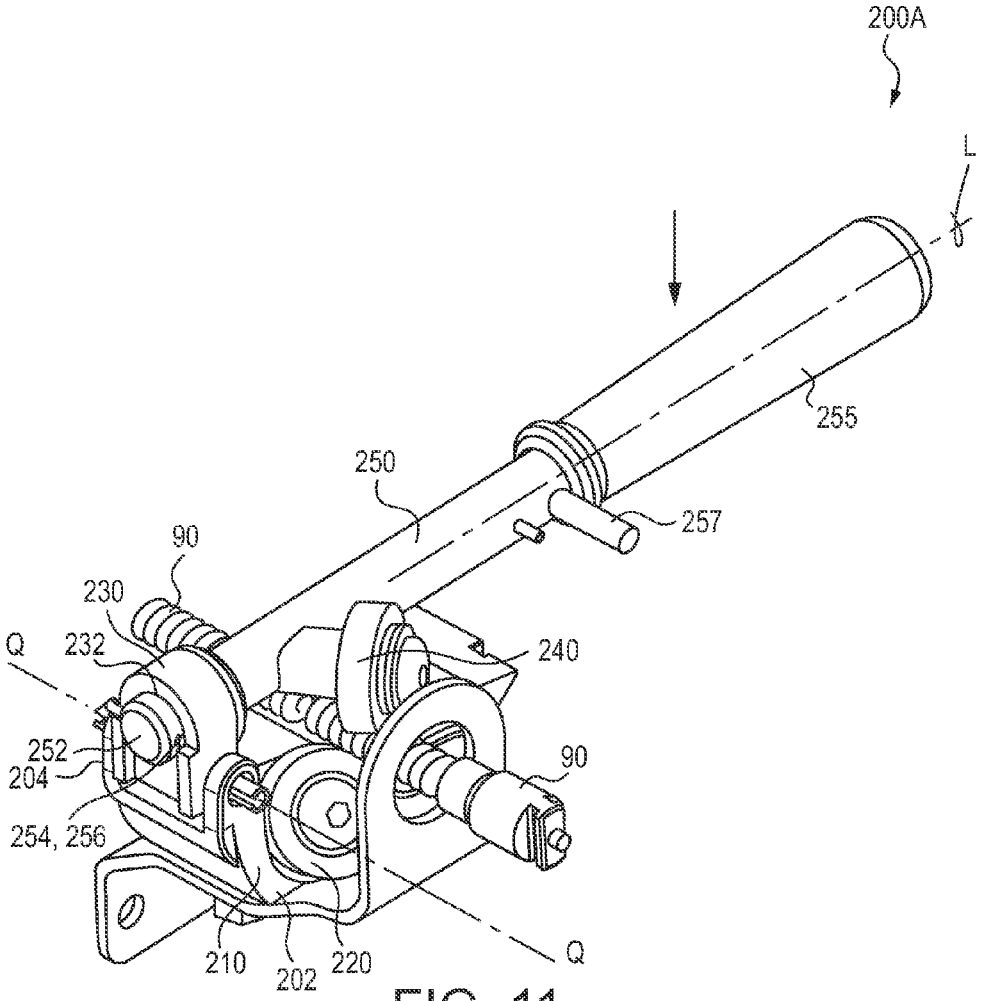
FIG. 11 is a perspective view of yet another embodiment of a feed control device in accordance with the present subject matter, the device being in a cable advance position.
Figure 12:
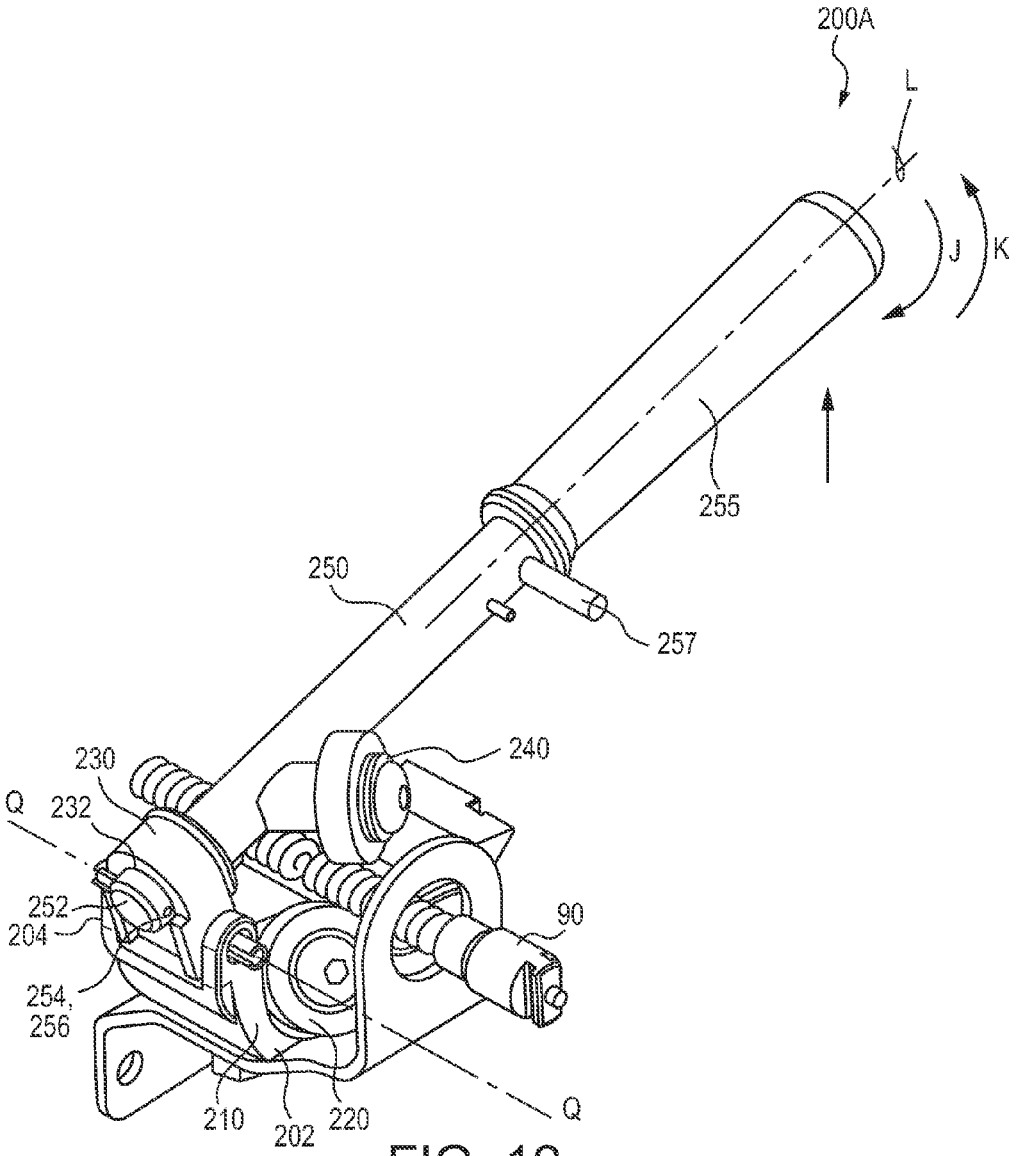
FIG. 12 is a perspective view of the feed control device of FIG. 11, illustrating changing direction of cable displacement.
Figure 13:
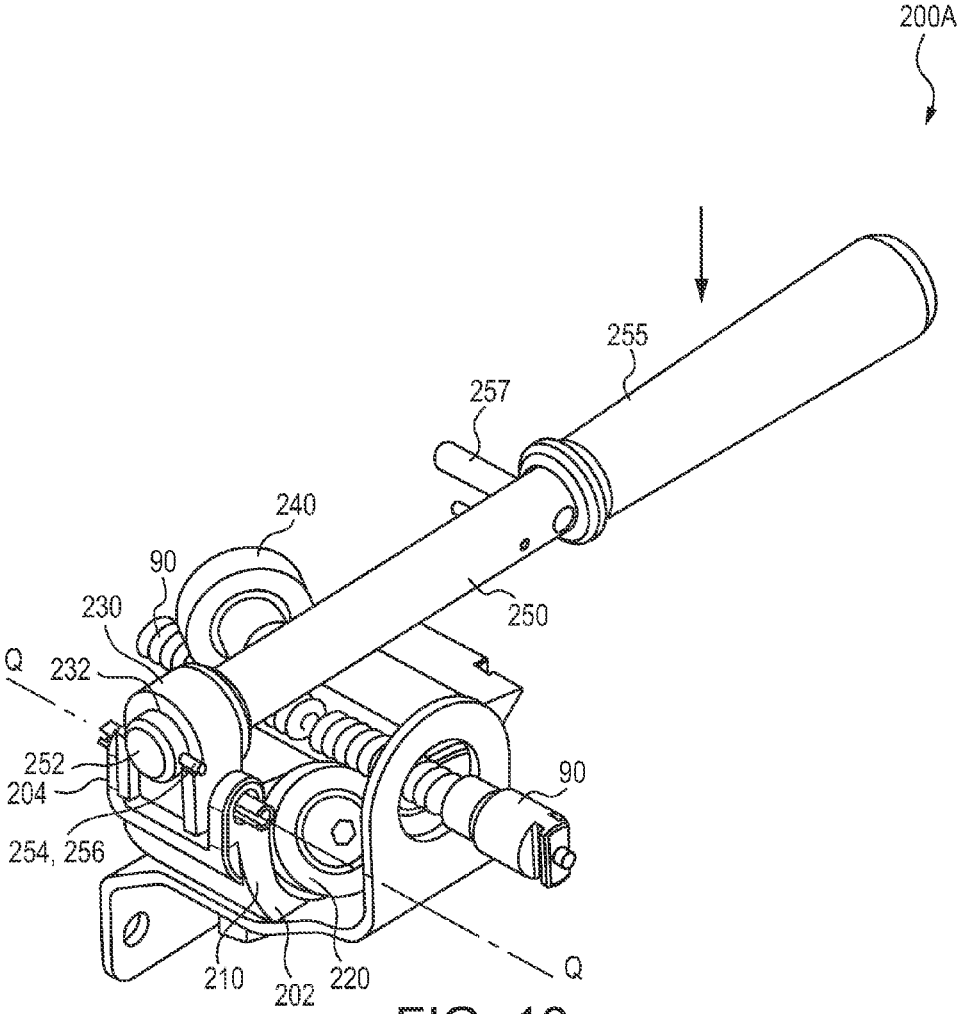
FIG. 13 is a perspective view of the feed control device of FIGS. 11 and 12, the device being in a cable retract position.

FIGS. 11-13 illustrate another embodiment of a feed control device 200A in accordance with the present subject matter. The device 200A utilizes a single upper roller which is selectively placed in contact with a drain cleaning cable by rotational positioning of a handle. Rotational positioning of the handle may be accompanied by raising or lifting of the handle as described in greater detail herein. Specifically, the feed control device 200A comprises a lower member 210 having a collection of lower rollers 220 rotatably mounted thereon. The lower member 210 defines a front region 202 and an opposite rear region 204. The device 200A also comprises an upper member 230 which is pivotally engaged to the lower member 210. The upper member 230 pivots about a pivot axis Q relative to the lower member 210. The feed control device 200A also comprises a single upper roller 240 rotatably attached to a handle 250. The handle 250 is rotatably engaged with the upper member 230 and can be rotationally positioned in the direction of arrows J and K as shown in FIG. 12. Although a variety of engagement assemblies and provisions can be used between the handle 250 and the upper member 230, the device 200A utilizes an aperture 232 defined in the upper member 230, through which an end 252 of the handle 250 extends. An aperture 254 extends through the handle 250 adjacent the end 252, and a retaining pin 256 is positioned within the aperture 254. The pin 256 provides a stop so the roller 240 remains in contact with the cable 90. Specifically, the handle 250 is configured such that upon lifting the handle, the handle is rotated so that the roller 240 is passed underneath the raised handle. Upon lowering the handle, the roller is contacted with the cable 90. Stop members are provided which prevent unintended rotation of the handle 250 upon lowering the handle. One or more gripping members 255 can be provided on the handle 250. The handle 250 is selectively rotated such as by rotating in the directions of arrows J and K in FIG. 12, to selectively position the roller 240 and contact that roller with a drain cleaning cable 90 placed on the collection of the lower rollers 220.

Figure 14:
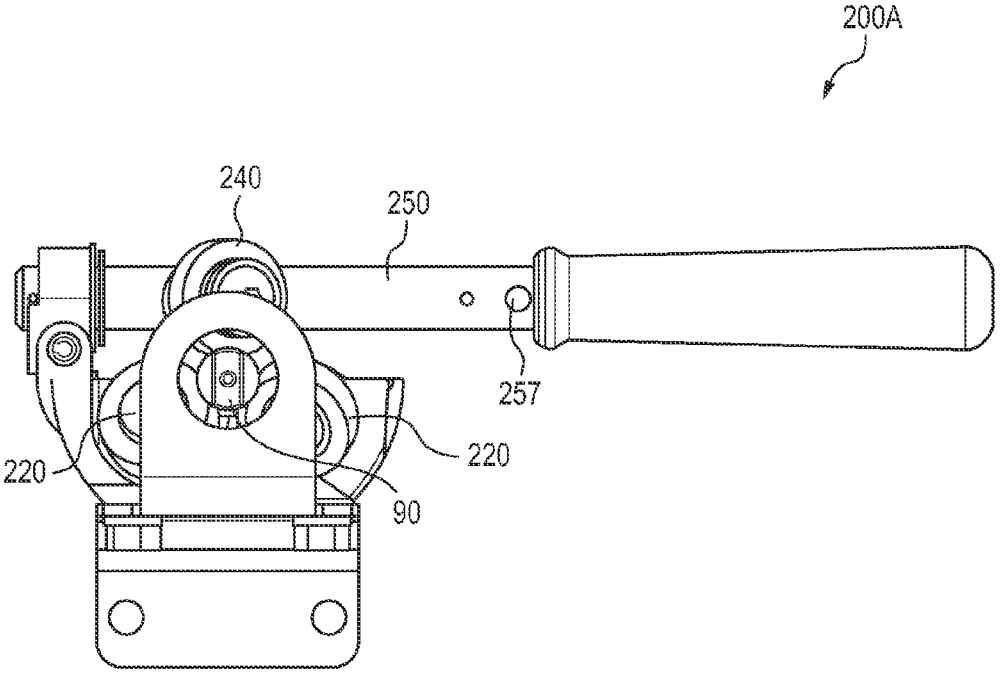
FIG. 14 is a front view of the feed control device of FIGS. 11-13, the device being in a cable advance position.
Figure 15:
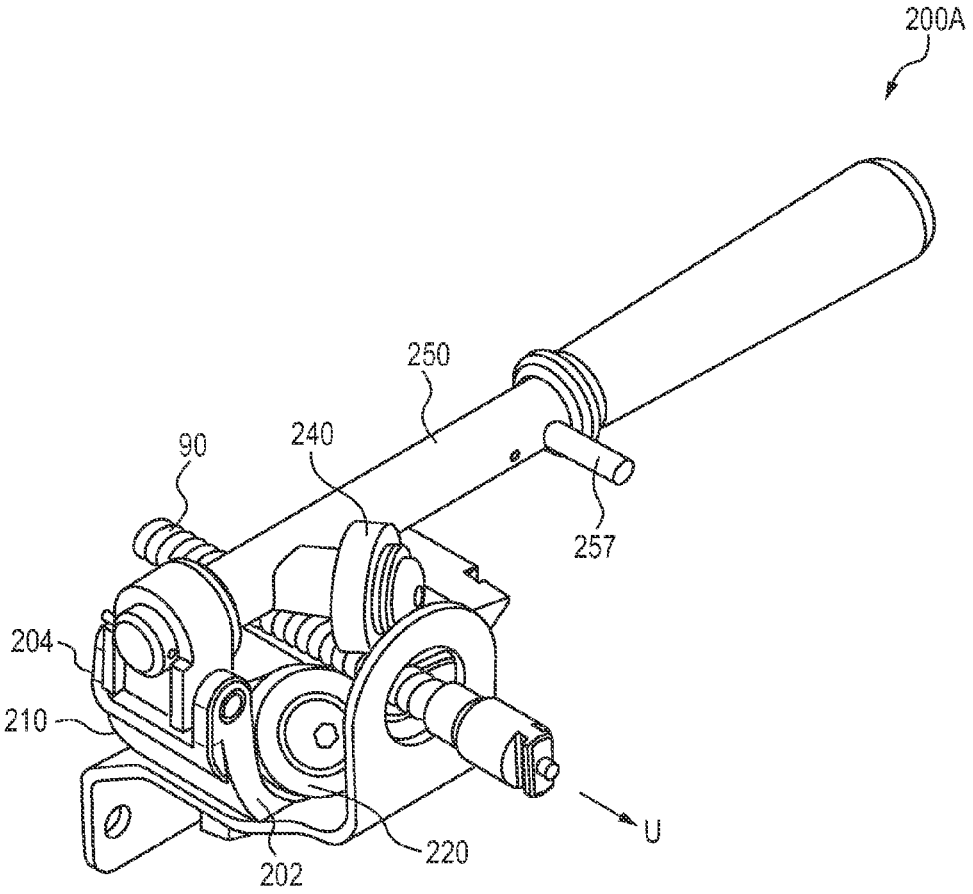
FIG. 15 is a perspective view of the feed control device shown in FIG. 14.
Figure 16:
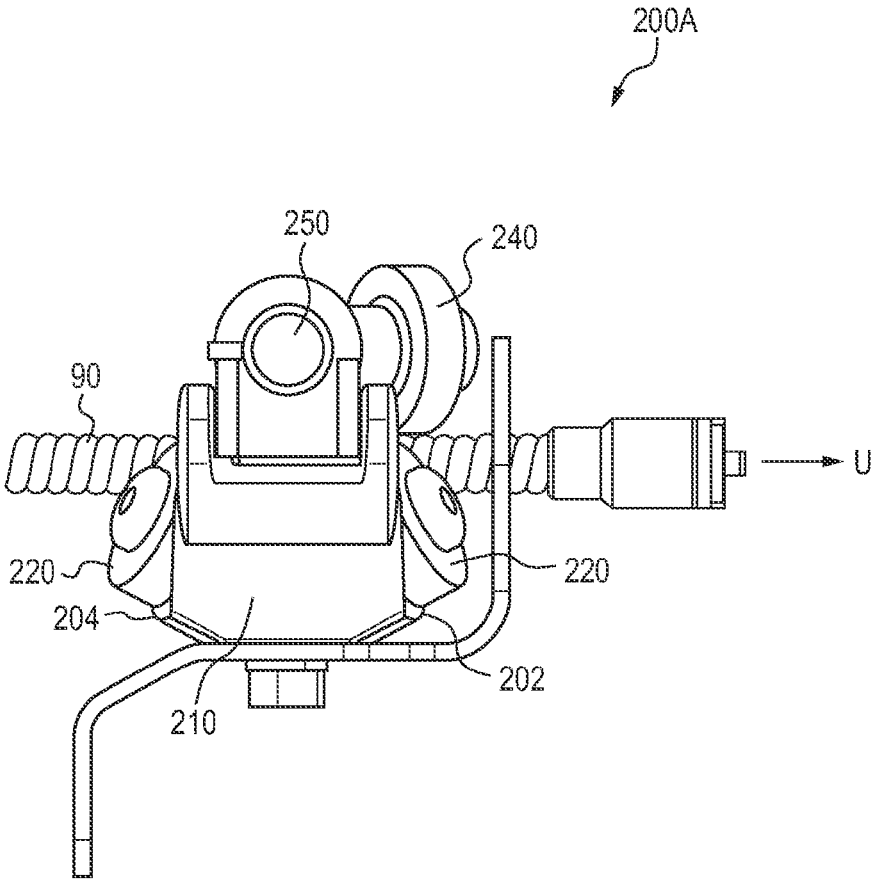
FIG. 16 is a side view of the feed control device of FIGS. 14 and 15.

FIGS. 14-16 illustrate the feed control device 200A of FIGS. 11-13 in a cable extension position in which a rotating cable 90 is axially displaced in the direction of arrow U. As evident, the handle 250 is oriented, i.e., by selective rotation about its longitudinal axis, such that the upper roller 240 is closer to the front region 202 of the lower member 210 than the rear region 204 of the lower member 210. In this cable extension position of the handle 250, the upper roller 240 contacts a drain cleaning cable 90 positioned between the lower rollers 220 and the upper roller 240.

Figure 17:
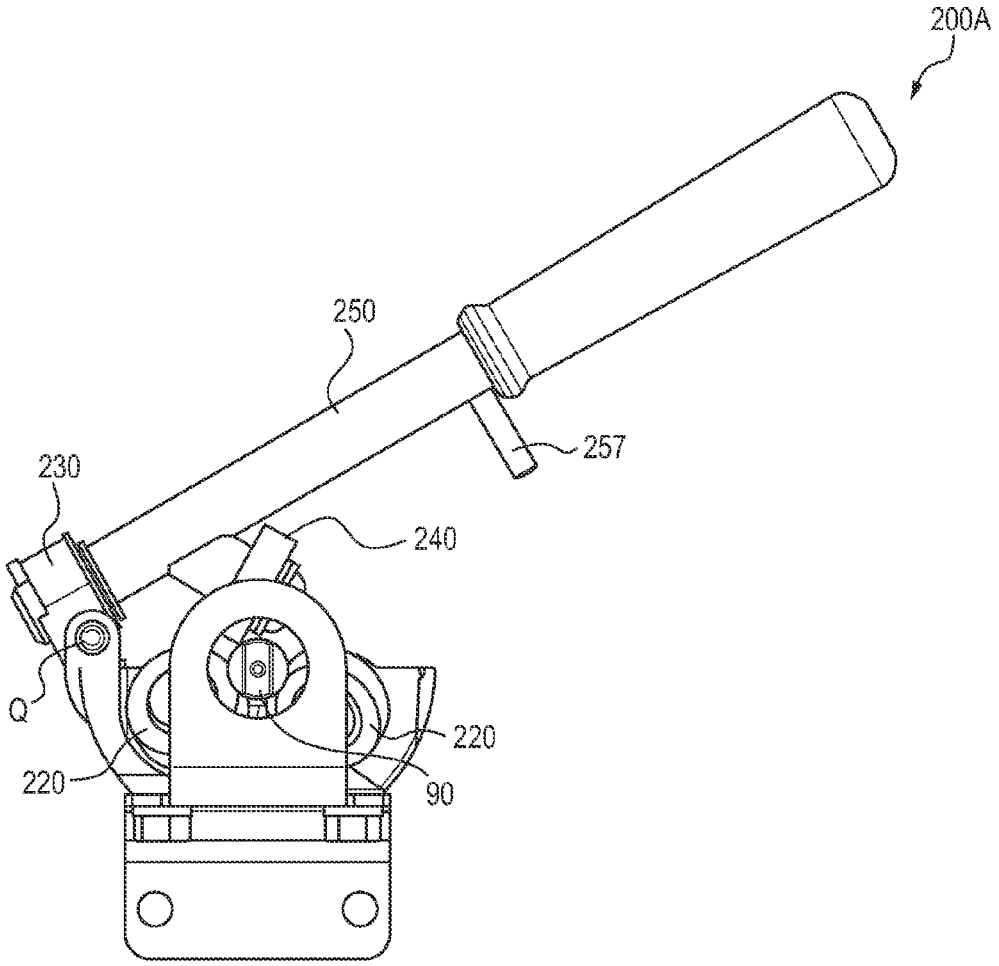
FIG. 17 is a front view of the feed control device of FIGS. 11-13, the device being in a neutral position.
Figure 18:
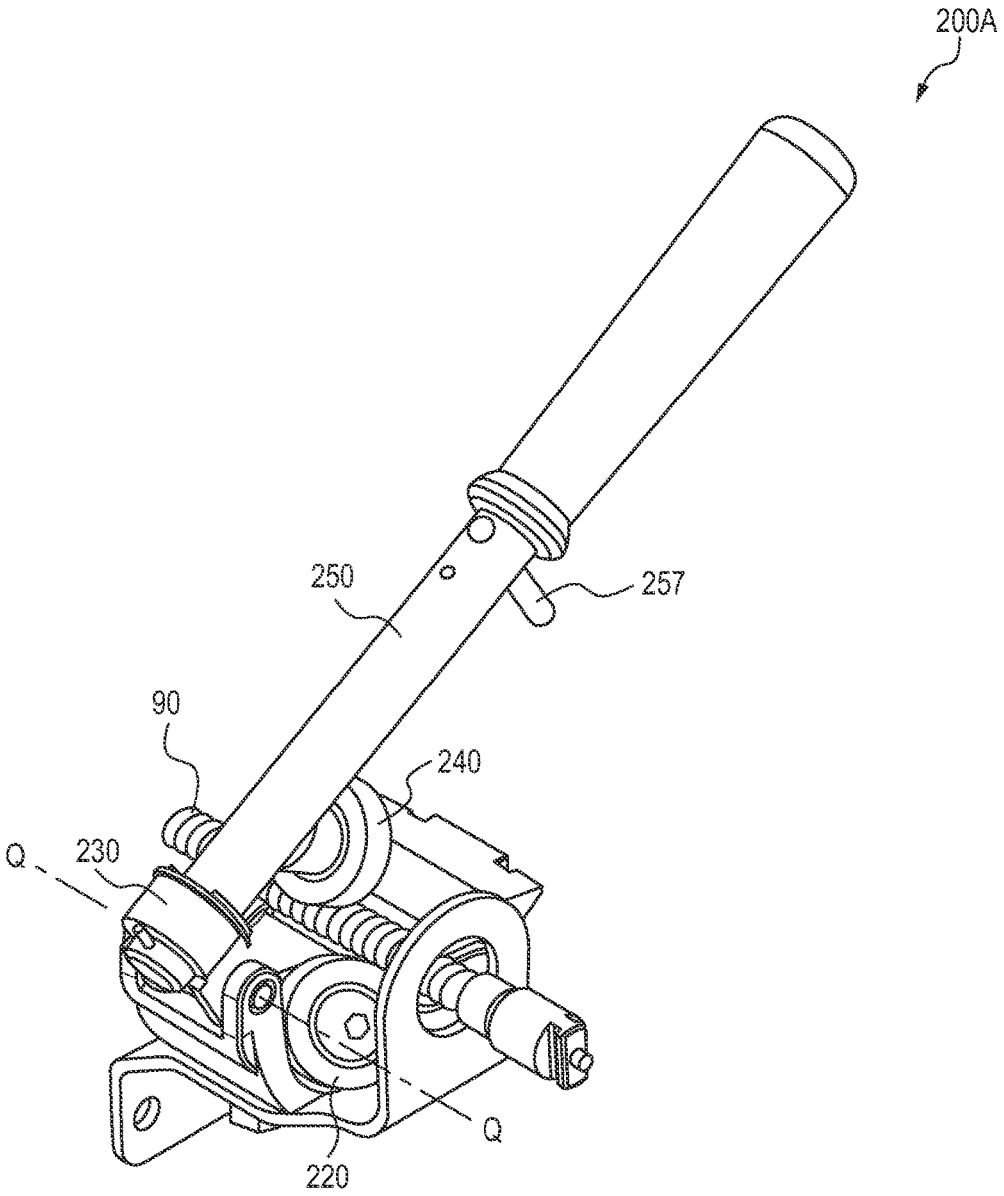
FIG. 18 is a perspective view of the feed control device shown in FIG. 17.
Figure 19:
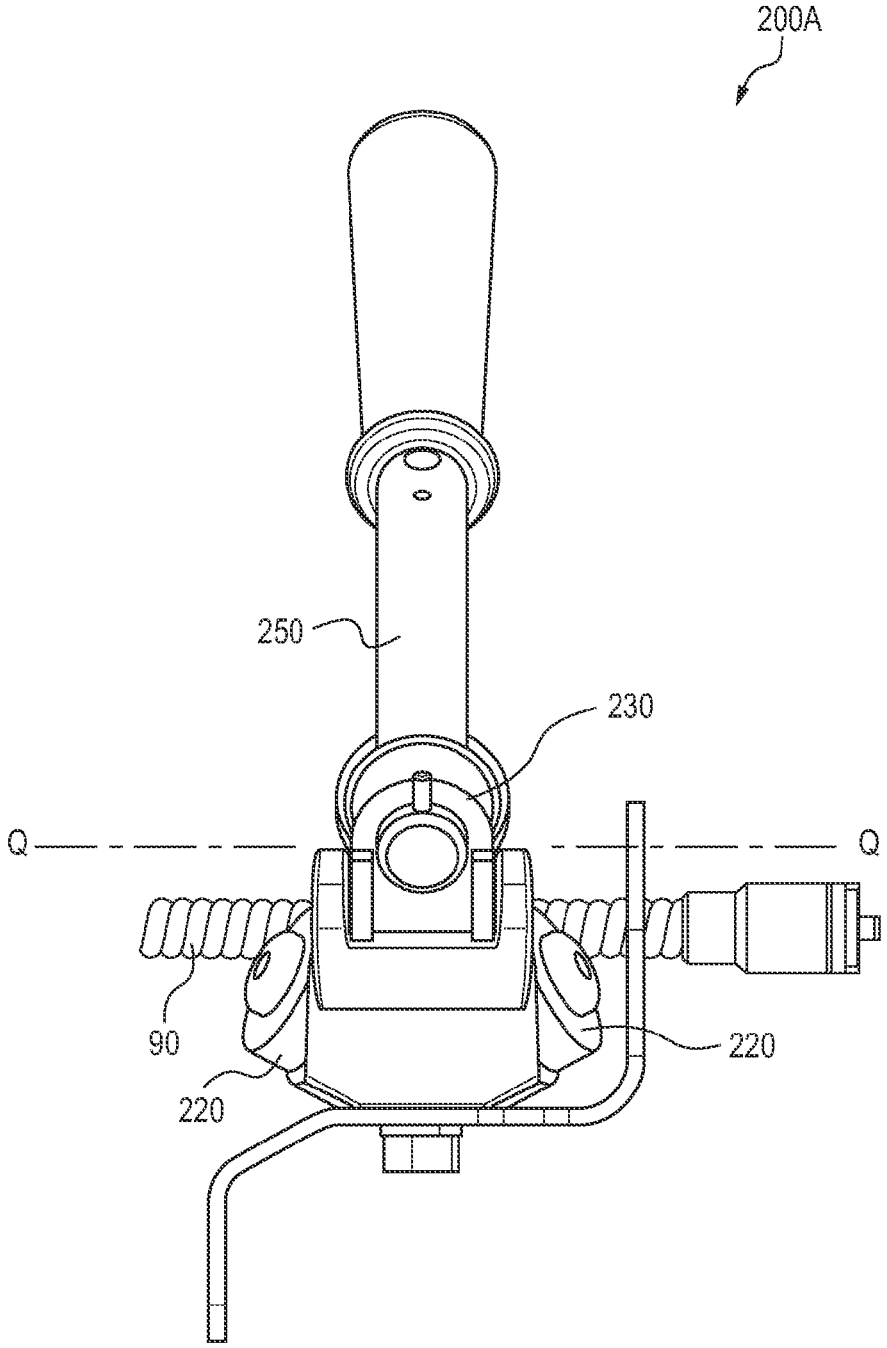
FIG. 19 is a side view of the feed control device of FIGS. 17 and 18.

FIGS. 17-19 illustrate the feed control device 200A of FIGS. 11-13 in a neutral position in which neither cable extension nor retraction occurs. In this position, the handle 250 is raised (as compared to the handle position shown in FIGS. 14-16) by pivoting the upper member 230 and the handle 250 about the pivot axis Q. In this raised position, typically contact does not occur between the upper roller 240 and the cable 90, however, as shown in the referenced figures, incidental contact can occur between the noted components.

Figure 20:
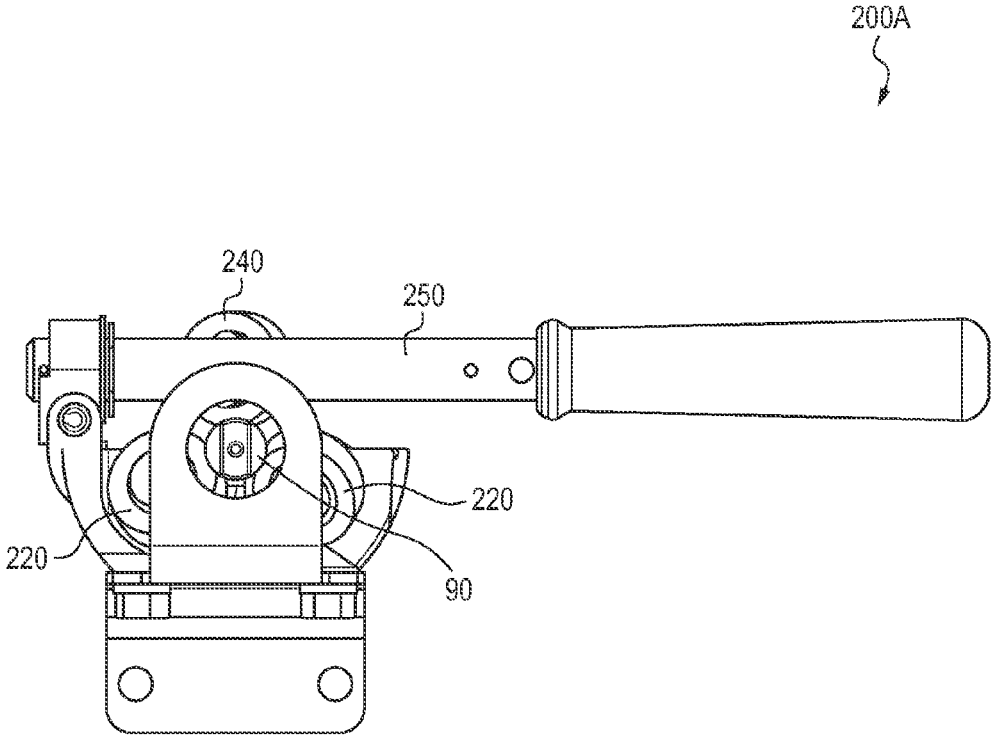
FIG. 20 is a front view of the feed control device of FIGS. 11-13, the device being in a cable retract position.
Figure 21:
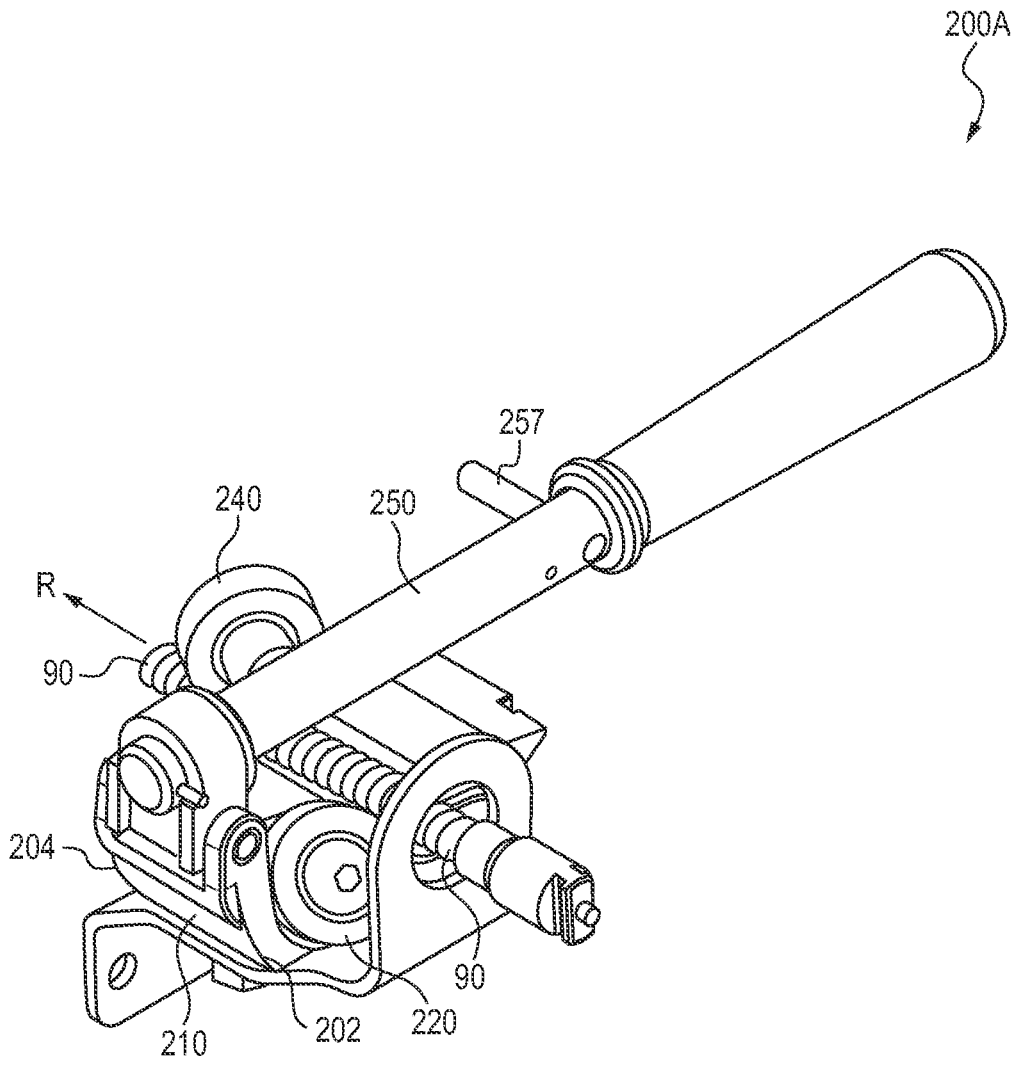
FIG. 21 is a perspective view of the feed control device shown in FIG. 20.
Figure 22:
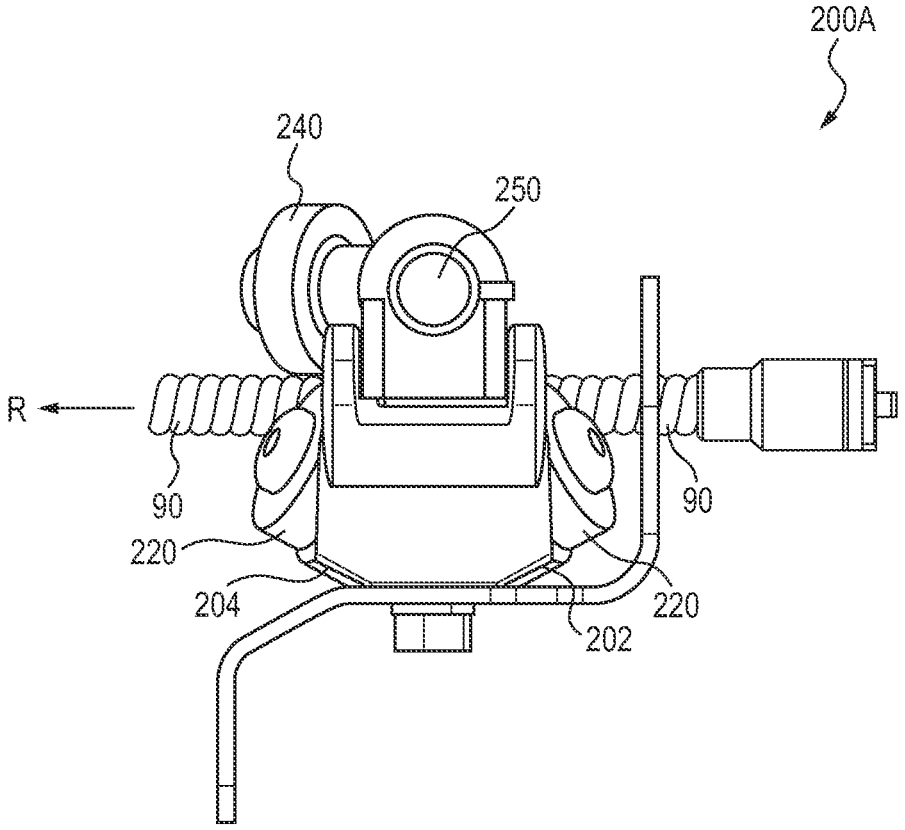
FIG. 22 is a side view of the feed control device of FIGS. 20 and 21.

FIGS. 20-22 illustrate the feed control device 200A of FIGS. 11-13 in a cable retract position in which a rotating cable 90 is axially displaced in the direction of arrow R. As evident, the handle 250 is oriented, i.e., by selective rotation about its longitudinal axis, such that the upper roller 240 is closer to the rear region 204 of the lower member 210 than the front region 202 of the lower member 210. In this cable retraction position of the handle 250, the upper roller 240 contacts a drain cleaning cable 90 positioned between the lower rollers 220 and the upper roller 240.

Referring further to FIGS. 14-22, when changing the position of the handle 250 such as from a cable extension position to a cable retraction position, the handle may be raised or lifted relative to the lower member. Such raising of the handle may facilitate rotating the handle about the longitudinal axis of the handle, and such lifting may provide clearance for the upper roller to pass between the raised handle and the drain cleaning cable. However, it will be understood that the present subject matter includes versions of the feed control device in which raising of the handle is not required when changing from one direction of cable displacement to the other if a latch or detent assembly is provided to maintain contact between the upper roller and the cable.

The feed control device 200A can optionally comprise provisions to readily indicate position of the device, i.e., whether the device is in a cable extension position, a cable retraction position, or a neutral position. Specifically, the indication provisions indicate whether the upper roller 240 is closer to the front region 202 or the rear region 204 of the lower member 210. FIGS. 11-22 illustrate an example of such indication provisions which can be in the form of a marker or projection 257 located on the handle 250. In the device 200A, the projection 257 is provided along a lateral or peripheral side region of the handle 250 such that upon rotation of the handle 250 about its longitudinal axis L, such as in the directions of arrows J and K in FIG. 12, the relative position of the projection 257 changes. In the versions shown in the noted figures, when the handle is oriented to a cable extension position, the projection 257 projects laterally outward from the handle and points toward the direction of cable extension such as indicated by arrow U in FIG. 15. Upon orienting the handle to a cable retraction position, the projection 257 points toward the direction of cable retraction such as indicated by arrow R in FIG. 21.

The feed control device 200A depicted in FIGS. 11-22 may optionally comprise biasing provisions that urge the handle 250 to one or more positions. For example, the device 200A can include one or more biasing members that urge the handle 250 to a rotational position corresponding to the position depicted in FIGS. 17-19. Instead or in addition, the device 200A can include one or more biasing members that urge the handle 250 to a raised position corresponding to the position shown in FIGS. 17-19. Specifically, the biasing provisions urge or bias at least one of, and typically both, the upper member and the handle to a neutral position in which neither cable displacement in the forward direction nor cable displacement in the rearward direction occurs. These biasing provisions can be in a variety of different forms such as but not limited to torsion springs.

FIGS. 23-34 illustrate another version 200B of the feed control device 200A depicted in FIGS. 11-22. The feed control device 200B utilizes a different engagement assembly between the handle 250 and the lower member 210 as compared to the feed control device 200A. Specifically, the feed control device 200B does not utilize an upper engagement member such as member 230. Instead, the device 200B utilizes a direct pivotable engagement between the handle 250 and the lower member 210.

The lower member 210 of the feed control device 200B includes a plurality of lower rollers 220 rotatably supported thereon. The lower member 210 defines a front region 202 and an opposite rear region 204. The lower member 210 also includes a rotatable post 206 that extends at least partially above the plurality of rollers 220. The device 200B also comprises a handle 250 which is engaged with the post 206. The handle 250 includes an upper roller 240 rotatably supported thereon.

Figure 24:
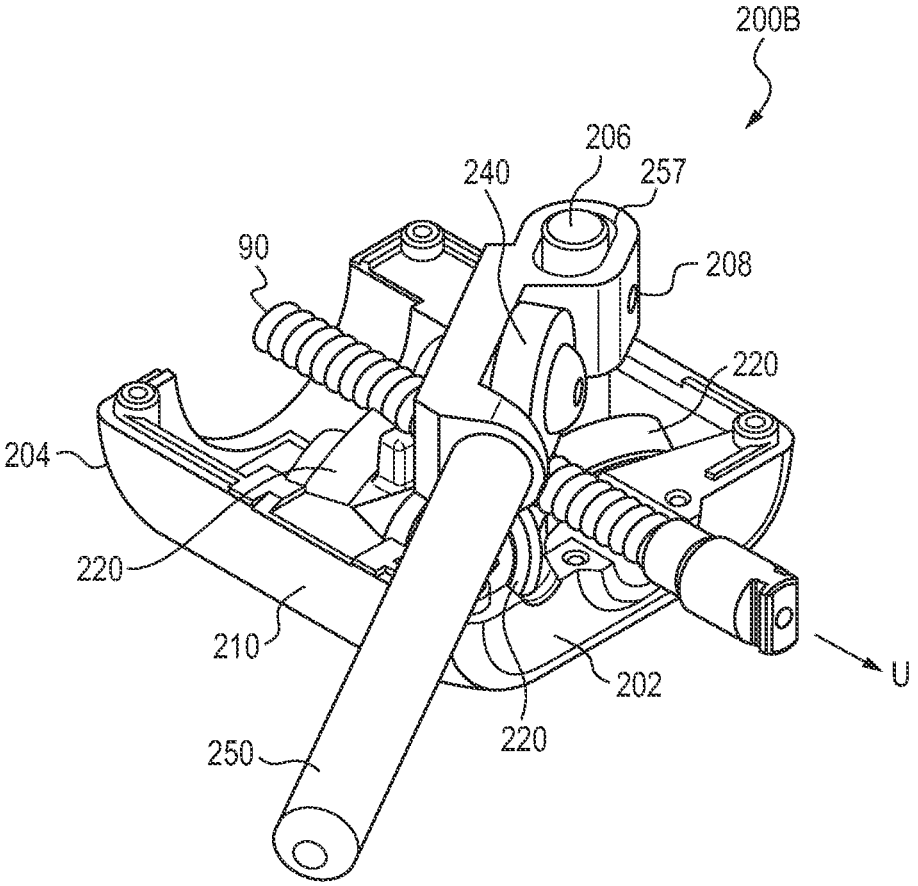
FIG. 24 is a perspective view of the feed control device shown in FIG. 23.
Figure 25:
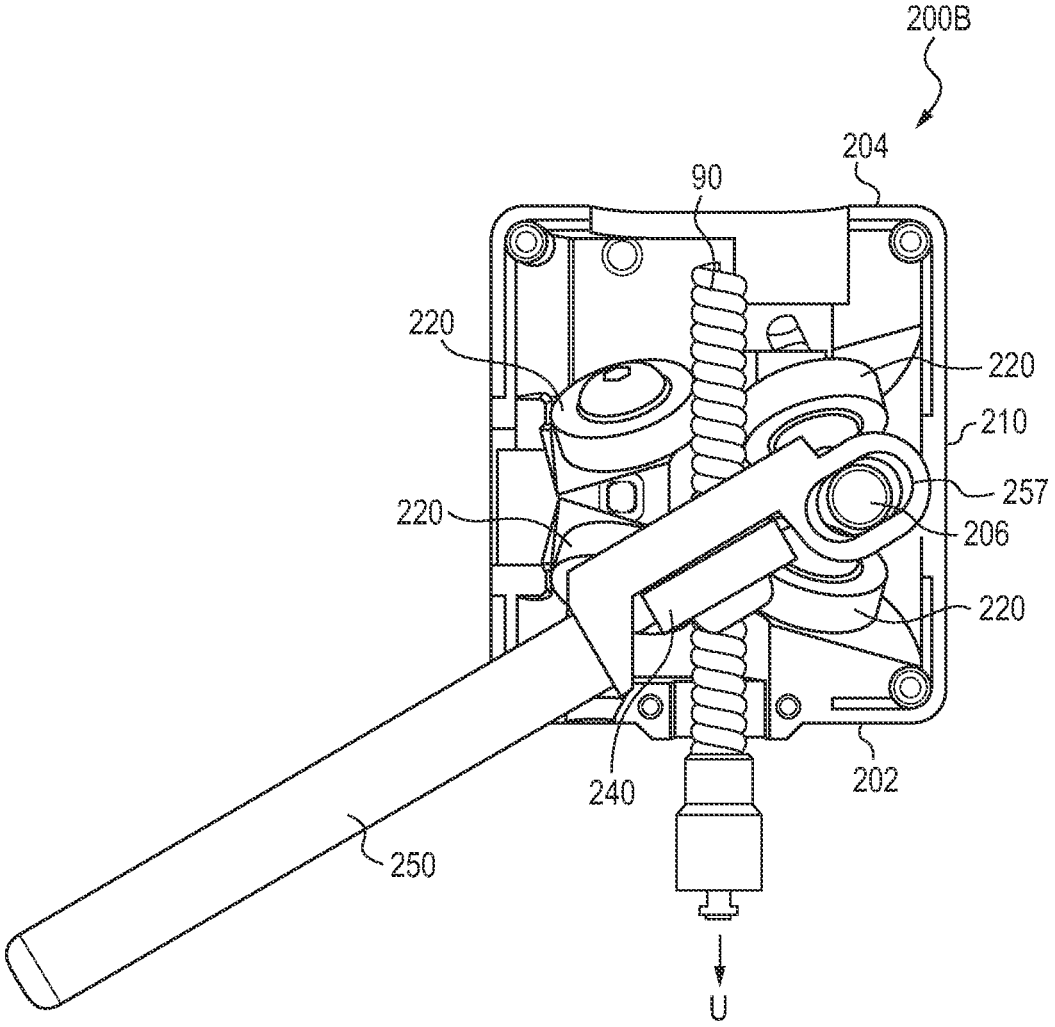
FIG. 25 is a top view of the feed control device depicted in FIGS. 23 and 24.
Figure 30:
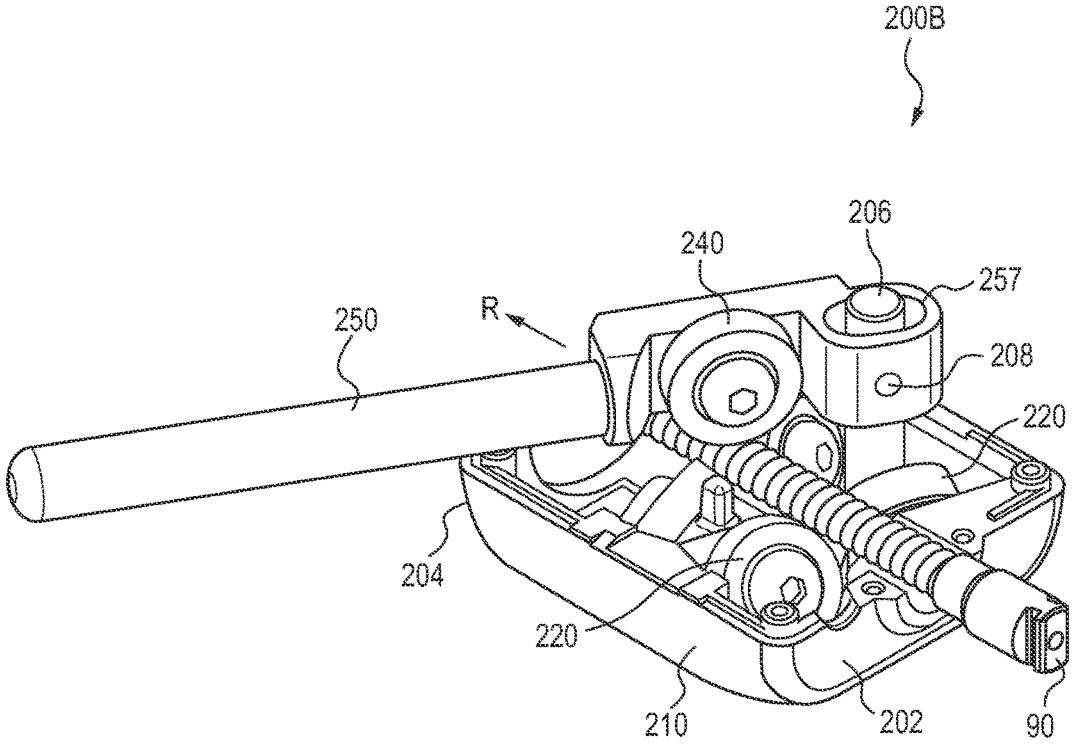
FIG. 30 is a perspective view of the feed control device shown in FIG. 29.
Figure 31:
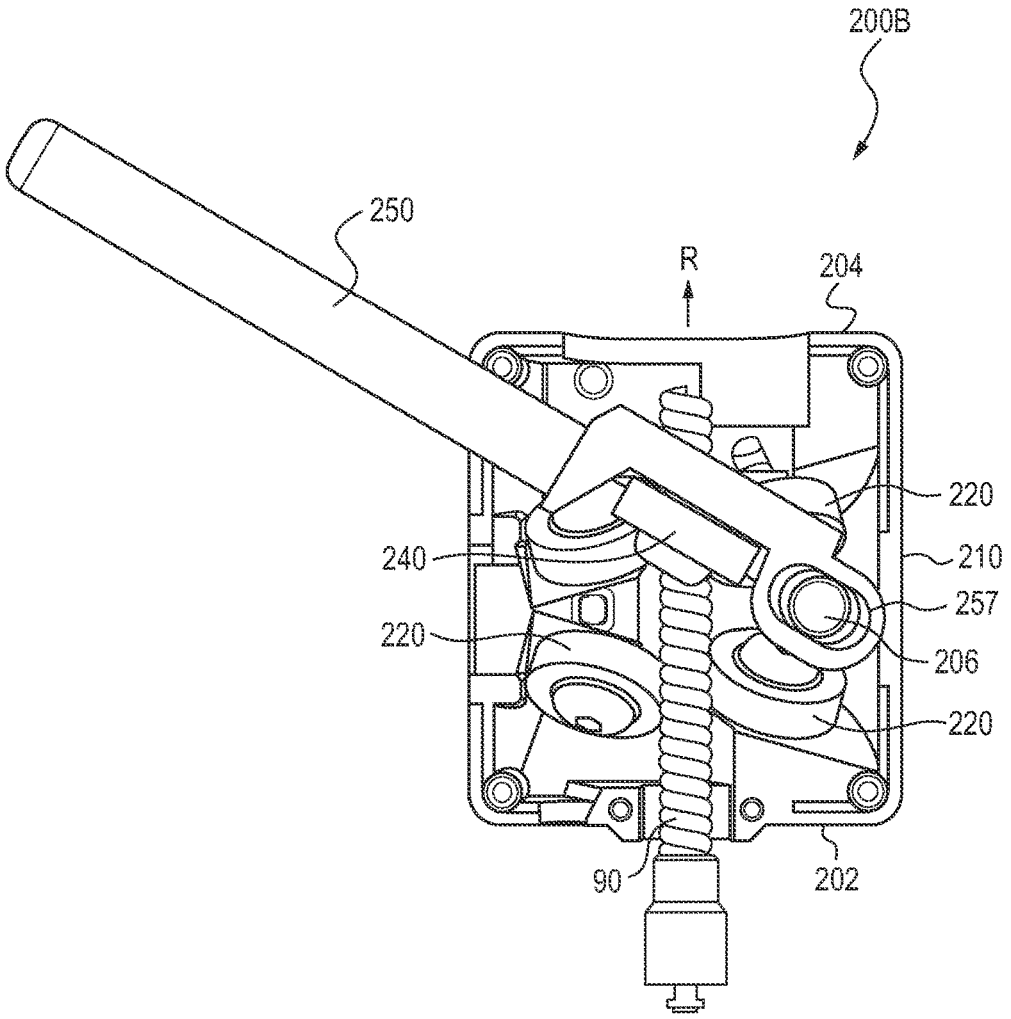
FIG. 31 is a top view of the feed control device depicted in FIGS. 29 and 30.

Upon placement of a drain cleaning cable 90 between the plurality of rollers 220 of the lower member 210 and the upper roller 240 and rotation of the cable 90 about its axis, positioning of the handle 250 so that the upper roller 240 is closer to the front region 202 of the lower member 210 than the rear region 204, and contacting the upper roller 240 with the drain cleaning cable 90, results in cable displacement in a forward position, shown by arrow U (FIGS. 24 and 25). Positioning of the handle 250 so that the upper roller 240 is closer to the rear region 204 of the lower member than the front region 202 and contacting the upper roller 240 with the drain cleaning cable 90, results in cable displacement in a rearward direction, shown by arrow R (FIGS. 30 and 31).

Figure 28:
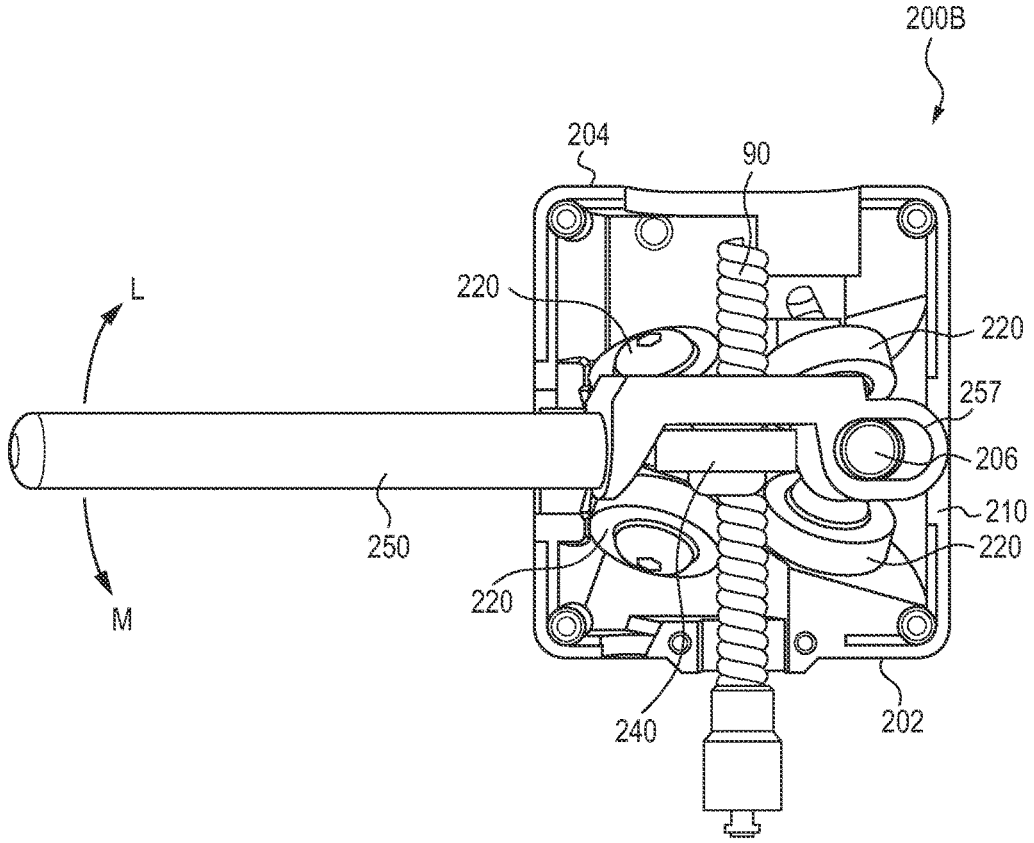
FIG. 28 is a top view of the feed control device depicted in FIGS. 26 and 27.
Figure 33:
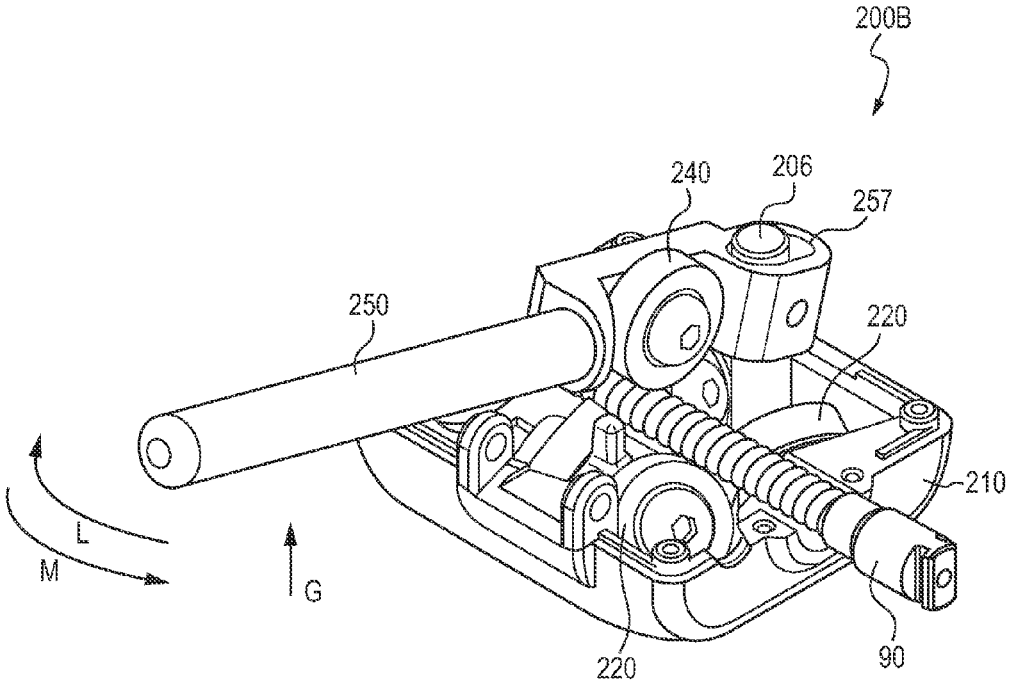
FIG. 33 is a perspective view of the feed control device of FIG. 32, illustrating changing direction of cable direction.

The handle 250 is pivotally engaged with the post 206 and can be pivotally positioned in the direction of arrows L and M as shown in FIGS. 28 and 33. Although a variety of engagement assemblies and provisions can be used between the handle 250 and the post 206, the device 200B utilizes an aperture 257 defined in the handle 250, through which the post 206 extends. One or more gripping members (not shown) can be provided on the handle 250. The handle 250 is selectively pivoted such as by pivoting in the directions of arrows L and M in FIG. 28, to selectively position the roller 240 and contact that roller with a drain cleaning cable 90 placed on the collection of the lower rollers 220.

Figure 23:
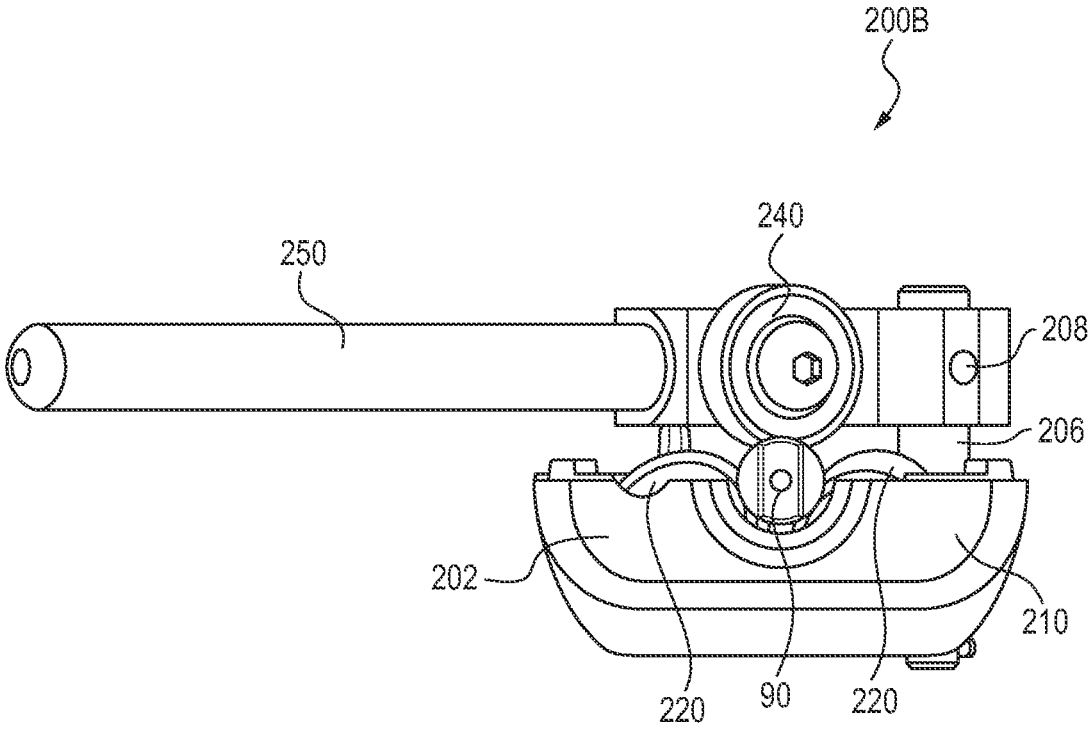
FIG. 23 is a front view of another version of the feed control device shown in FIGS. 11-22, the device being in a cable advance position.

Specifically, FIGS. 23-25 illustrate the feed control device 200B in a cable extension position. As evident, the handle 250 is oriented, i.e., by selective pivoting with the post 206, such that the upper roller 240 is closer to the front region 202 of the lower member 210 than the rear region 204 of the lower member 210. In this cable extension position of the handle 250, the upper roller 240 contacts a drain cleaning cable 90 positioned between the lower rollers 220 and the upper roller 240. Specifically, the handle 250 is pivotally attached to the post 206 by a pivot pin 208.

Figure 26:
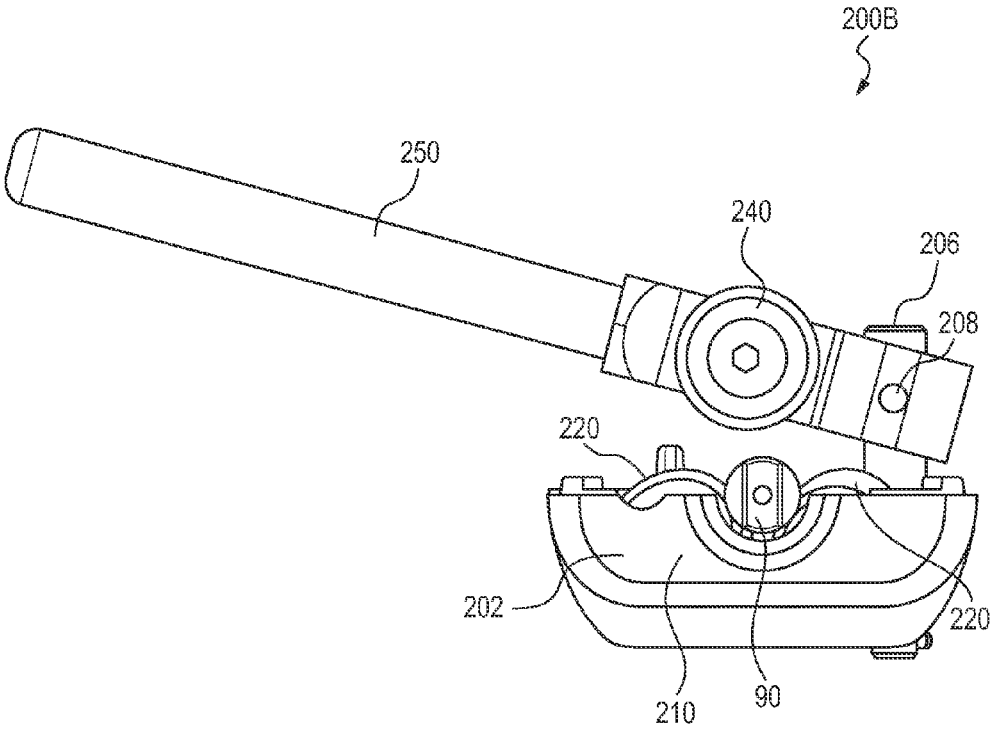
FIG. 26 is a front view of the feed control device of FIGS. 23-25, the device being in a neutral position.
Figure 27:
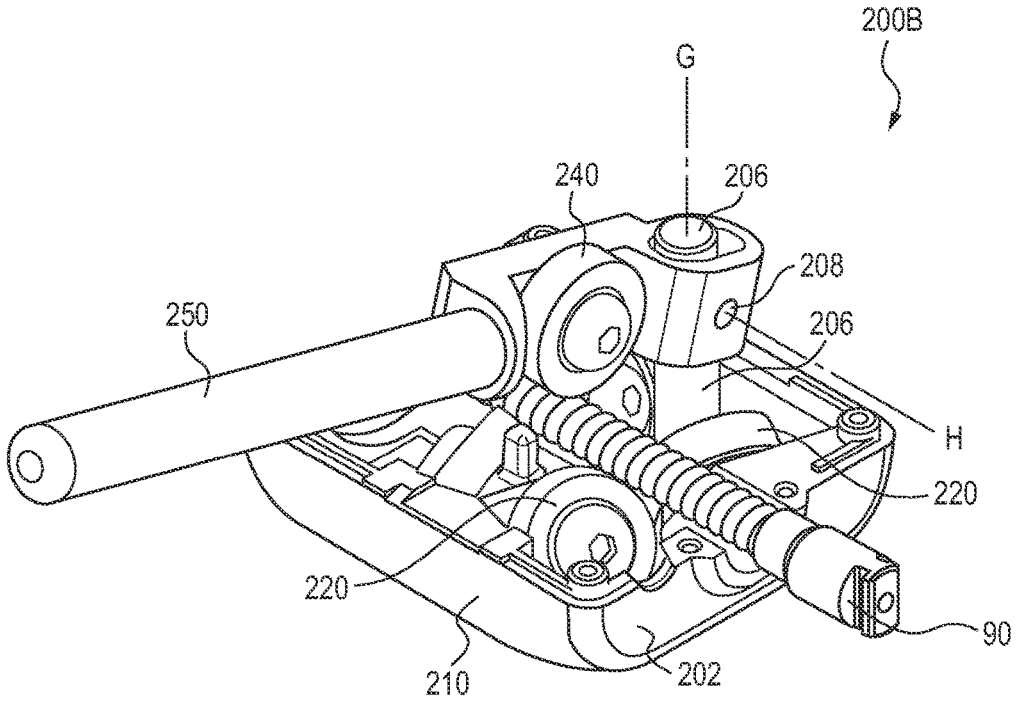
FIG. 27 is a perspective view of the feed control device shown in FIG. 26.

FIGS. 26-28 illustrate the feed control device 200B in a neutral position in which neither cable extension nor retraction occurs. In this position, the handle 250 is positioned to an intermediate position by raising the handle 250 about pivot pin 208 extending in the post 206. Pivoting the handle 250 upwards achieves a neutral position. In this intermediate position, typically contact does not occur between the upper roller 240 and the cable 90, however incidental contact can occur between the noted components. As best shown in FIG. 27, the handle 250 is pivotable about pivot pin 208, also shown as axis H. And, the rotatable post 206 is rotatable or pivotable about axis G.

Figure 29:
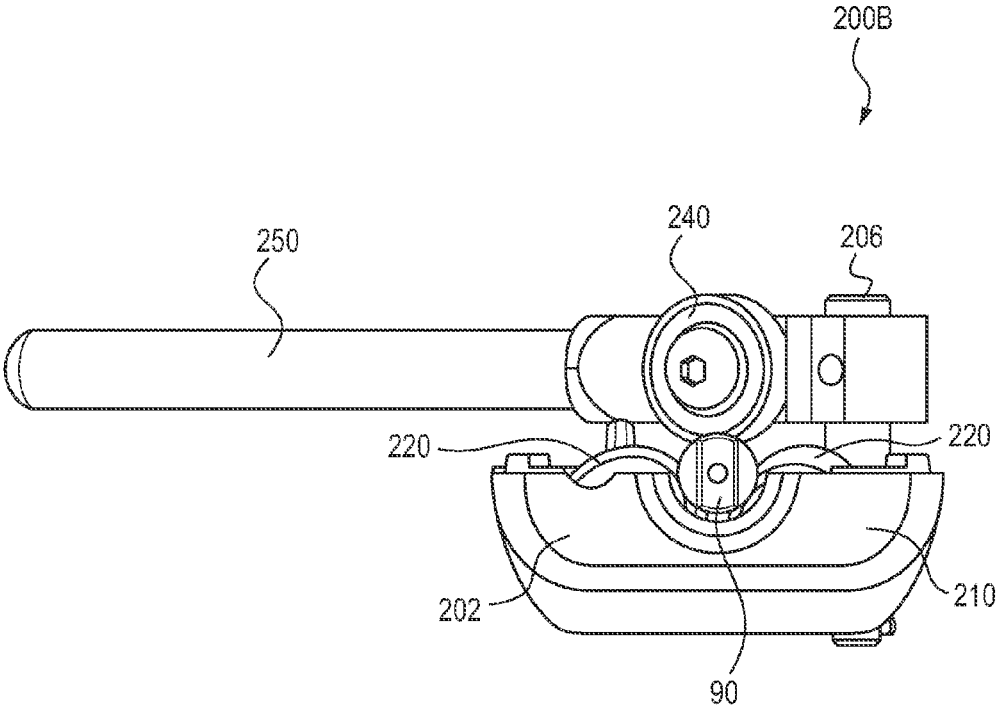
FIG. 29 is a front view of the feed control device of FIGS. 23-28, the device being in a cable retract position.

FIGS. 29-31 illustrate the feed control device 200B in a cable retract position. As evident, the handle 250 is oriented, i.e., by selective pivoting with post 206, such that the upper roller 240 is closer to the rear region 204 of the lower member 210 than the front region 202 of the lower member 210. In this cable retraction position of the handle 250, the upper roller 240 contacts a drain cleaning cable 90 positioned between the lower rollers 220 and the upper roller 240.

Figure 32:
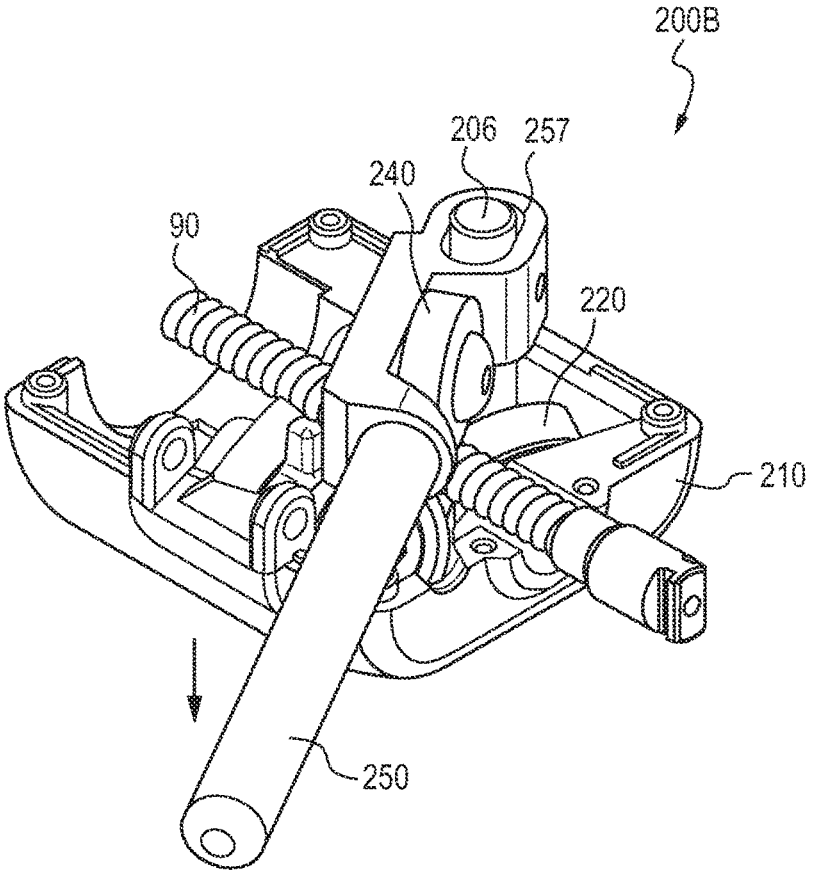
FIG. 32 is a perspective view of the feed control device shown in FIGS. 23-31, the device being in a cable advance position.
Figure 34:
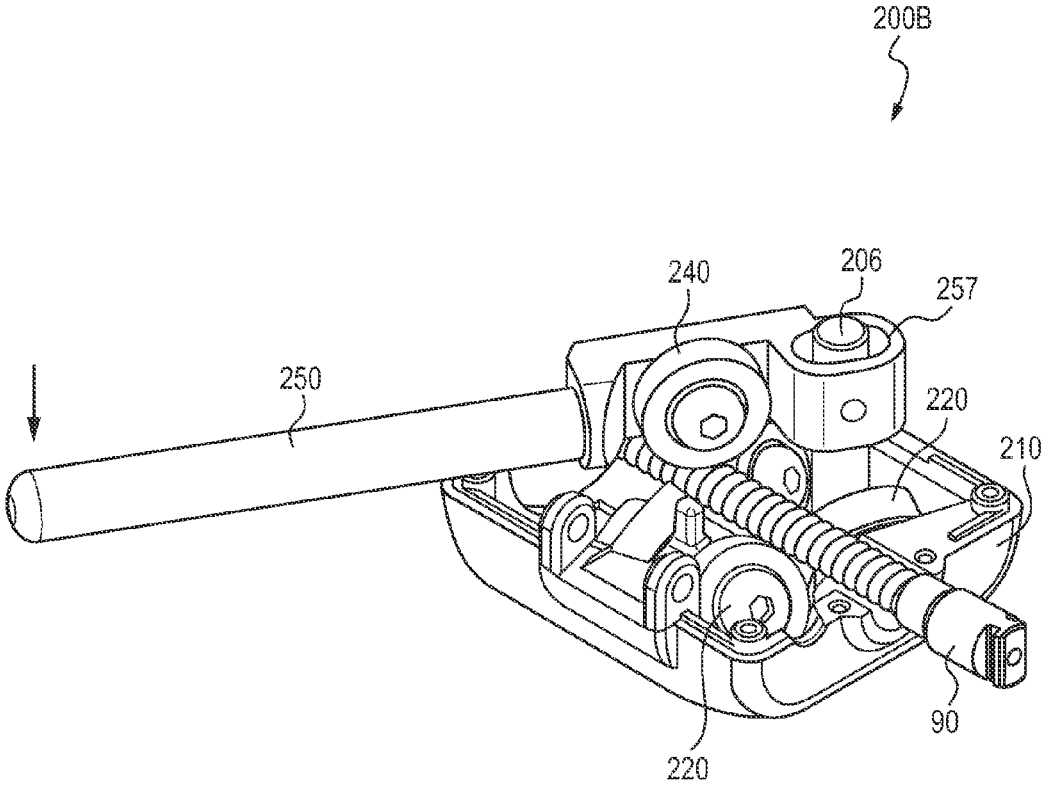
FIG. 34 is a perspective view of the feed control device of FIGS. 32 and 33, the device being in a cable retract position.

Referring further to FIGS. 32-34, when changing the position of the handle 250 such as from a cable extension position to a cable retraction position for example, the handle 250 may optionally be raised or lifted, relative to the lower member 210. This range of motion can be facilitated by utilizing a non-circular aperture in the handle, through which the post 206 extends. For example, if a slot shaped aperture is used such as aperture 257, the handle 250 can be raised or lifted as shown in FIG. 33 by arrow G, while still engaged with the post. However, it will be appreciated that the present subject matter includes pivoting engagement assemblies between the handle and the post in which the only range of permitted motion is pivoting about the post without raising or lifting so long as the upper roller 240 is maintained in contact with the cable.

The feed control device 200B depicted in FIGS. 23-34 may optionally comprise biasing provisions that urge the handle 250 to one or more positions. For example, the device 200B can include one or more biasing members that urge the assembly of handle 250 and post 206 to a pivotal neutral position corresponding to the position depicted in FIGS. 26-28. Instead or in addition, the device 200B can include one or more biasing members that urge the handle 250 to a raised position corresponding to the position best shown in FIG. 26. Specifically, the biasing provisions urge or bias the handle 250 to a neutral position in which neither cable displacement in the forward direction nor cable displacement in the rearward direction occurs. These biasing provisions can be in a variety of different forms such as but not limited to torsion springs.

Figure 35:
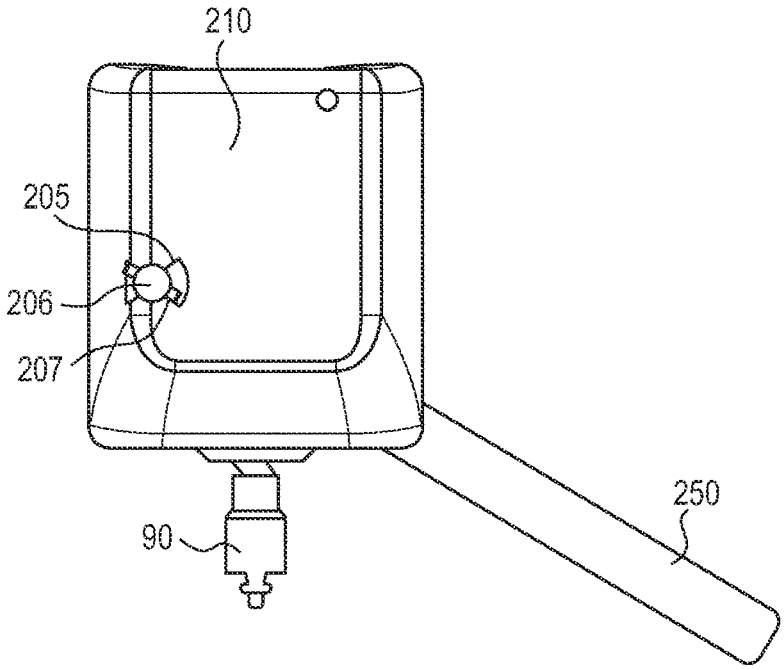
FIG. 35 is a view of the underside of the feed control device of FIGS. 23-34, the device being in a cable advance position.
Figure 36:
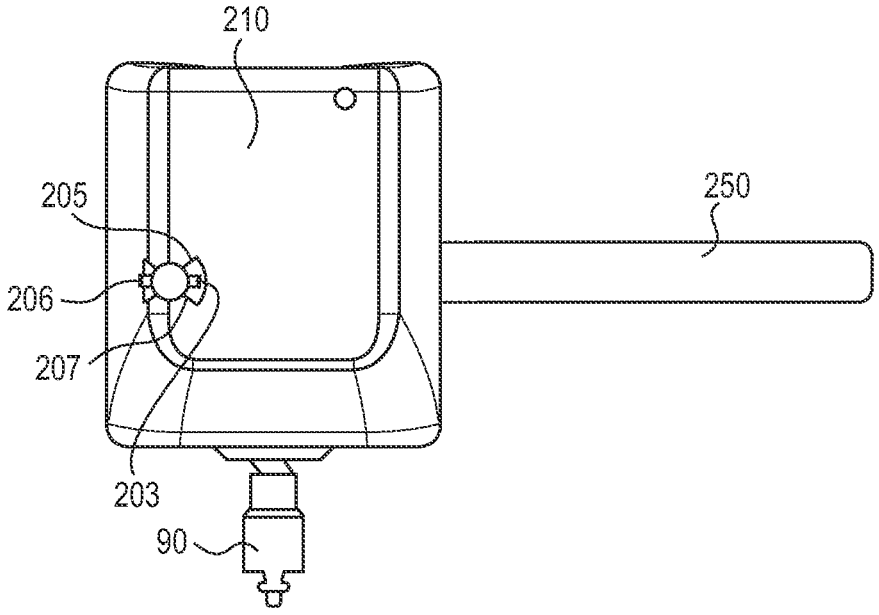
FIG. 36 is a view of the underside of the feed control device of FIGS. 23-34, the device being in a neutral position.
Figure 37:
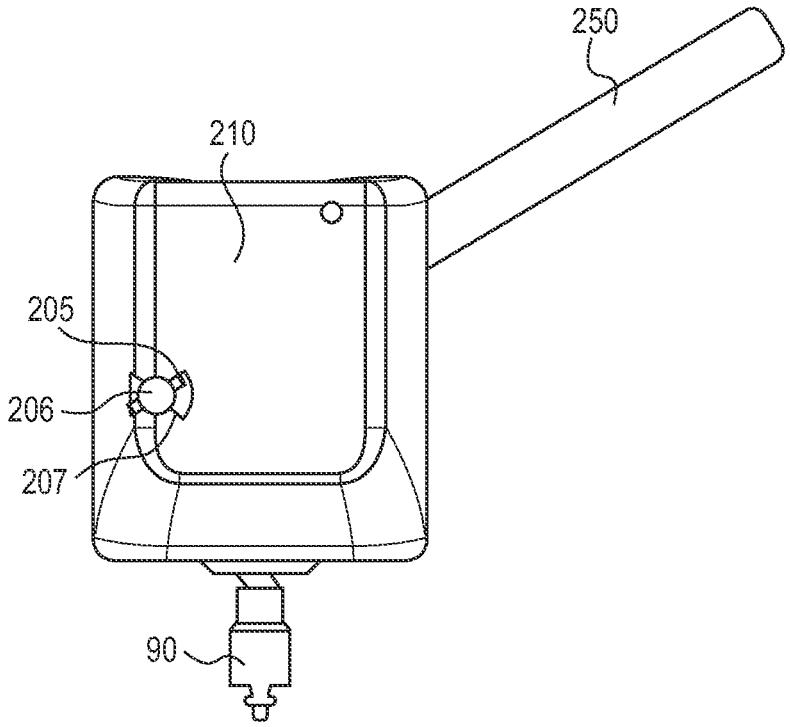
FIG. 37 is a view of the underside of the feed control device of FIGS. 23-34, the device being in a cable retract position.

FIGS. 35-37 illustrate the underside of the lower member 210 and a representative stop configuration for limiting rotational movement of the post 206 about axis G (see FIG. 27). The post 206 can include an outwardly extending stop member 203 which is received within a recessed region defined between a first stop surface 205 and a second stop surface 207. Upon positioning the lever 250 and the post 206 to a cable advance position such as shown in FIG. 35, the stop member 203 contacts the first stop surface 207. Upon positioning the lever 250 and the post 206 to a cable retract position such as shown in FIG. 37, the stop member 203 contacts the second stop surface 205.

Figure 38:
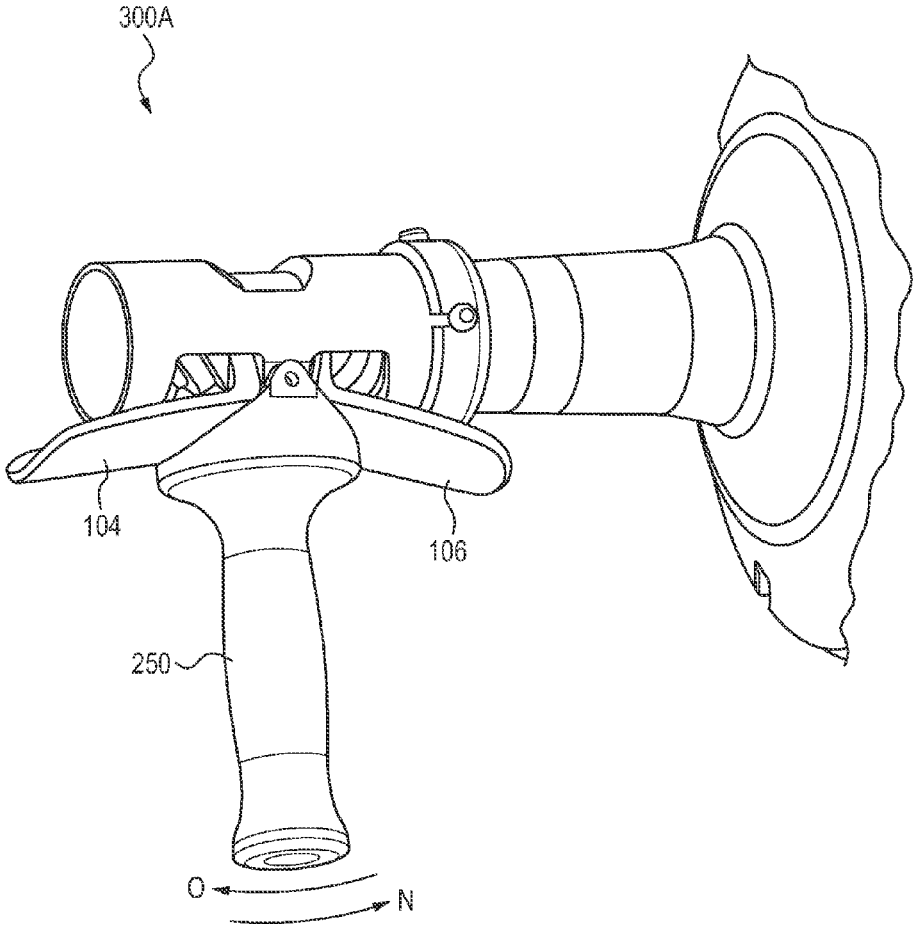
FIG. 38 is a perspective view of still another embodiment of a feed control device in accordance with the present subject matter.
Figure 39:
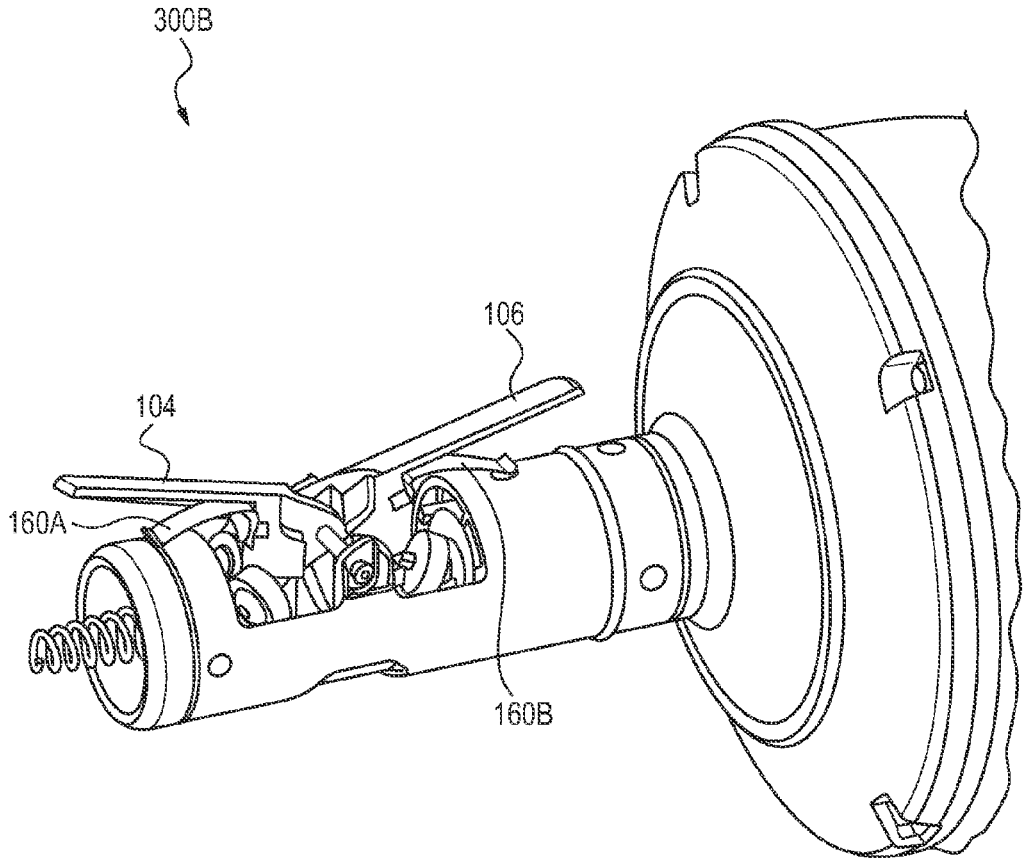
FIG. 39 is a perspective view of yet another embodiment of a feed control device in accordance with the present subject matter.

FIGS. 38 and 39 illustrate variant embodiments 300A and 300B of a feed control device which is described in U.S. Pat. No. 7,685,669. Thus, the roller assemblies of the feed control devices 300A and 300B utilize the same roller assemblies as described in the noted '669 patent. Specifically, FIG. 38 illustrates a handle 250 which is positioned on and engaged with a pair of paddles 104 and 106. Again, as previously noted, the paddles 104 and 106 and their operation are described in the noted '669 patent. The handle 250 is affixed to the paddles and locks or otherwise engages the two paddles together. As described in the '669 patent, upon pressing on either of the paddles 104, 106, the other paddle will retract or no longer contact a drain cleaning cable. The handle 250 enables selection of either of the paddles 104, 106 by movement of the handle 250 in either of the directions shown by arrows N and O. Thus, actuation of paddle 104 is achieved by movement of the handle 250 in the direction of arrow O. And, actuation of paddle 106 is achieved by movement of the handle 250 in the direction of arrow N.

FIG. 39 illustrates another feed control device 300B generally corresponding to that described in the noted '669 patent. The feed control device 300B includes paddles 104 and 106 that operate as noted in the '669 patent. The device 300B includes one or more biasing members 160A and 160B which urge the paddles 104, 106 to an intermediate or center position, corresponding to no cable extension or retraction.

The present subject matter also provides various drain cleaning devices which utilize the feed control mechanisms described herein to control cable extension and/or cable retraction. Generally, the drain cleaners comprise a frame and a rotatable drum supported on the frame, such as depicted in FIG. 2. The drain cleaners also comprise a motor operably engaged with the drum for rotating the drum. An example of such is shown in FIG. 1. The drain cleaner also comprises a length of drain cleaning cable at least partially stored in the drum. And, the drain cleaner comprises any of the feed control devices described herein.

Many other benefits will no doubt become apparent from future application and development of this technology.

All patents, applications, standards, and articles noted herein are hereby incorporated by reference in their entirety.

The present subject matter includes all operable combinations of features and aspects described herein. Thus, for example if one feature is described in association with an embodiment and another feature is described in association with another embodiment, it will be understood that the present subject matter includes embodiments having a combination of these features.

As described hereinabove, the present subject matter solves many problems associated with previous strategies, systems and/or devices. However, it will be appreciated that various changes in the details, materials and arrangements of components, which have been herein described and illustrated in order to explain the nature of the present subject matter, may be made by those skilled in the art without departing from the principle and scope of the claimed subject matter, as expressed in the appended claims.

What is claimed is:

1. A feed control device comprising:

a lower member including a plurality of rollers rotatably supported thereon;

an upper member including at least one roller rotatably supported thereon;

a handle engaged with the upper member;

wherein the upper member is pivotally engaged with the lower member and the upper member and the handle are positionable between a forward position and a rearward position;

wherein (i) upon placement of a drain cleaning cable between the plurality of rollers of the lower member and the at least one roller of the upper member, and (ii) rotation of the drain cleaning cable about its axis, movement of the upper member and the handle to the forward position results in cable displacement in the same forward direction, and movement of the upper member and the handle to the rearward position results in cable displacement in the same rearward direction.

2. The feed control device of claim 1 wherein the upper member pivots relative to the lower member, about a pivot axis, and the pivot axis is perpendicular to an axis of the drain cleaning cable upon placement of the drain cleaning cable between the plurality of rollers of the lower member and the at least one roller of the upper member.

3. The feed control device of claim 1 wherein the upper member includes a first roller and a second roller, both rollers rotatably supported on the upper member.

4. The feed control device of claim 1 further comprising biasing provisions which urge the upper member and the handle to an intermediate position between the forward position and the rearward position.

5. The feed control device of claim 4 wherein upon positioning the upper member and the handle to the intermediate position, the at least one roller of the upper member is free from contact with the drain cleaning cable.

6. The feed control device of claim 4 wherein the biasing provisions include a spring extending between the upper member and the lower member.

7. The feed control device of claim 4 wherein the angular difference between the intermediate position and the forward position as measured from a longitudinal axis of the handle is within a range of from 10° to 45°.

8. The feed control device of claim 7 wherein the angular difference is 22°.

9. The feed control device of claim 4 wherein the angular difference between the intermediate position and the rearward position as measured from a longitudinal axis of the handle is within a range of from 10° to 45°.

10. The feed control device of claim 9 wherein the angular difference is 22°.

11. The feed control device of claim 1 wherein the plurality of rollers supported on the lower member includes a total of four rollers.

12. The feed control device of claim 1 wherein upon moving the handle between the forward position and the rearward position, the handle moves in a direction generally parallel with the axis of the drain cleaning cable placed between the plurality of rollers of the lower member and the at least one roller of the upper member.

13. A feed control device comprising:

a lower member including a plurality of rollers rotatably supported thereon, the lower member defining a front region and an opposite rear region;

an upper member pivotally engaged with the lower member;

a handle rotationally engaged with the upper member, the handle including an upper roller rotatably supported thereon;

wherein (i) upon placement of a drain cleaning cable between the plurality of rollers of the lower member and the upper roller and (ii) rotation of the drain cleaning cable about its axis, positioning of the upper member and the handle so that the upper roller is closer to the front region of the lower member than the rear region and contacting the upper roller with the drain cleaning cable, results in cable displacement in a forward direction.

* * * * *